US010265581B2

(12) United States Patent
O'Connor

(10) Patent No.: US 10,265,581 B2
(45) Date of Patent: Apr. 23, 2019

(54) DYNAMICALLY ADAPTIVE WEIGHT LIFTING APPARATUS

(71) Applicant: Christopher S. O'Connor, Livonia, MI (US)

(72) Inventor: Christopher S. O'Connor, Livonia, MI (US)

( * ) Notice: Subject to any disclaimer, the term of this patent is extended or adjusted under 35 U.S.C. 154(b) by 15 days.

(21) Appl. No.: 15/588,052

(22) Filed: May 5, 2017

(65) Prior Publication Data

US 2017/0319905 A1 Nov. 9, 2017

Related U.S. Application Data

(60) Provisional application No. 62/374,442, filed on Aug. 12, 2016, provisional application No. 62/332,839, filed on May 6, 2016.

(51) Int. Cl.
*A63B 21/00* (2006.01)
*A63B 23/04* (2006.01)
(Continued)

(52) U.S. Cl.
CPC ..... *A63B 24/0087* (2013.01); *A63B 21/062* (2013.01); *A63B 21/4047* (2015.10);
(Continued)

(58) Field of Classification Search
CPC ..... A63B 24/0087; A63B 21/4047; A63B 71/0622; A63B 23/03583; A63B 21/062; A63B 2225/50; A63B 2225/20; A63B 2225/09; A63B 2220/44; A63B 2220/34; A63B 2220/24; A63B 2220/17; A63B 2071/0694; A63B 2024/0093; A63B 23/1281; A63B 23/08; A63B 23/0494; A63B 21/0628; A63B 21/154; A63B 2220/16
See application file for complete search history.

(56) References Cited

U.S. PATENT DOCUMENTS 4,544,154 A 8/1985 Ariel
4,650,185 A 3/1987 Cartwright
(Continued)

OTHER PUBLICATIONS

Tampa Motions Company, Premium Electric Linear Actuator LA-04 (225lbs), LA-04 Product Information, https://www.tampamotions.com/collections/linear-actuators-1/products/premium-linear-actuator-la-04, 8 pages, (May 5, 2017).

*Primary Examiner* — Gary D Urbiel Goldner
(74) *Attorney, Agent, or Firm* — Brooks Kushman P.C.

(57) ABSTRACT

A weight training apparatus includes a telescoping pivot arm comprised of a concentric arrangement of an outer tube and an inner tube and configured to pivot about an axis and receive a weight at a predetermined position. The weight training apparatus further includes an actuator attached to the telescoping pivot arm and configured to cause relative motion between the inner tube and the outer tube to change a length between the predetermined position and the axis. The weight training apparatus further includes a sensor configured to output a signal indicative of an angular position of the telescoping pivot arm about the axis and a controller programmed to operate the actuator to cause the length to change based on the signal to achieve a target resistance profile.

19 Claims, 20 Drawing Sheets

(51) Int. Cl.

| | |
|---|---|
| ***A63B 23/08*** | (2006.01) |
| ***A63B 23/12*** | (2006.01) |
| ***A63B 24/00*** | (2006.01) |
| ***A63B 71/06*** | (2006.01) |
| ***A63B 21/062*** | (2006.01) |
| ***A63B 23/035*** | (2006.01) |

(52) U.S. Cl.

CPC .... *A63B 23/03583* (2013.01); *A63B 71/0622* (2013.01); *A63B 21/0628* (2015.10); *A63B 21/154* (2013.01); *A63B 23/0494* (2013.01); *A63B 23/08* (2013.01); *A63B 23/1281* (2013.01); *A63B 2024/0093* (2013.01); *A63B 2071/0694* (2013.01); *A63B 2220/16* (2013.01); *A63B 2220/17* (2013.01); *A63B 2220/24* (2013.01); *A63B 2220/34* (2013.01); *A63B 2220/44* (2013.01); *A63B 2225/09* (2013.01); *A63B 2225/20* (2013.01); *A63B 2225/50* (2013.01)

(56) References Cited

U.S. PATENT DOCUMENTS

| | | | | |
|---|---|---|---|---|
| 4,863,161 | A | 9/1989 | Telle | |
| 4,919,418 | A | 4/1990 | Miller | |
| 5,624,353 | A | 4/1997 | Naidus | |
| 6,676,574 | B1 * | 1/2004 | Prokop | A63B 21/0615 482/100 |
| 7,811,207 | B2 * | 10/2010 | Stearns | A63B 22/001 482/52 |
| 7,854,685 | B2 | 12/2010 | Cole et al. | |
| 7,976,441 | B2 | 7/2011 | Ellis | |
| 8,360,935 | B2 | 1/2013 | Olsen et al. | |
| 9,272,179 | B2 | 3/2016 | Lemos et al. | |
| 9,506,542 | B2 | 11/2016 | Wu | |
| 2011/0136628 | A1 * | 6/2011 | Stearns | A63B 22/001 482/52 |
| 2013/0017932 | A1 * | 1/2013 | Tayebi | A63B 69/06 482/94 |
| 2015/0105223 | A1 * | 4/2015 | Bissu | A63B 21/00076 482/99 |

* cited by examiner

DYNAMICALLY ADAPTIVE WEIGHT LIFTING APPARATUS

CROSS-REFERENCE TO RELATED APPLICATIONS

This application claims the benefit of U.S. provisional application Ser. No. 62/332,839 filed May 6, 2016 and U.S. provisional application Ser. No. 62/374,442 filed on Aug. 12, 2016, the disclosures of which are hereby incorporated in their entirety by reference herein.

TECHNICAL FIELD

This application generally relates to a weight training apparatus with dynamically adaptive force adjustment.

BACKGROUND

Weight training systems allow a user to train various muscles in the body by providing a resistance against motion. A weight training system may be configured to isolate a particular muscle or set of muscles. For example, a weight training system may be designed to exercise arm muscles (e.g., biceps, triceps) or leg muscles. Weight training systems may utilize hydraulic, pneumatic, spring, or brake systems to provide the resistance. Some systems may provide effective resistance during the lift but not during the release portion of the cycle.

Many weight training systems utilize a complicated set of pulleys and cables coupled to one or more weights to provide the resistance. Such systems may improve the feel of the workout, but the complexity and number of moving parts makes assembly and maintenance difficult.

SUMMARY

An exercise machine includes a pivoting arm that rotates about an axis. The pivoting arm is configured to receive one or more weights. The pivoting arm is further configured to adjust a distance of the weights from the axis to adjust a torque about the axis. The exercise machine includes a controller that is programmed to adjust the distance.

A weight training apparatus includes a telescoping pivot arm comprised of a concentric arrangement of an outer tube and an inner tube and configured to pivot about an axis and receive a weight at a predetermined position. The weight training apparatus further includes an actuator attached to the telescoping pivot arm and configured to cause relative motion between the inner tube and the outer tube to change a length between the predetermined position and the axis. The weight training apparatus further includes a sensor configured to output a signal indicative of an angular position of the telescoping pivot arm about the axis. The weight training apparatus further includes a controller programmed to operate the actuator to cause the length to change based on the signal to achieve a target resistance profile.

The target resistance profile may be a constant torque resistance over a predetermined range of angular motion. The telescoping pivot arm may be configured such that the outer tube is rotatably coupled to a shaft that defines the axis and the inner tube receives the weight at the predetermined position, and a drive unit of the actuator is attached to the outer tube. The telescoping pivot arm may be further configured to receive a cable at the predetermined position, wherein the cable is coupled to a weight stack.

The controller may be further programmed to, in response to a rate of change of the signal being indicative of the angular position changing at a rate less than a predetermined rate while the signal indicates that the telescoping pivot arm is rotating away from a rest position of the telescoping pivot arm, operate the actuator to cause the length to decrease. The controller may be further programmed to operate the actuator to increase the length when the signal indicates rotation of the telescoping pivot arm more than a first predetermined angle away from a starting position and toward a peak position and decrease the length when the signal indicates rotation of the telescoping pivot more than a second predetermined angle away from the peak position toward the starting position. The controller may be further programmed to operate the actuator to increase the length by a predetermined amount in response to the signal being indicative of a start of a repetition.

The weight training apparatus may further include a user interface including a display and the controller may be further programmed to output, to the display, an average over a predetermined number of repetitions of a force value that is based on the length and the angular position derived from the signal. The user interface may include an input element configured to provide an input signal for selecting an exercise profile and the controller may be further programmed to receive the input signal, and in response to the input signal, change the target resistance profile according to the exercise profile that is selected.

The controller may be further programmed to operate the actuator to increase the length for each repetition of an exercise cycle until a rate of change of the signal falls below a predetermined rate while the angular position is increasing within a predetermined angle range. The controller may be further programmed to, in response to a rate of change of the signal being indicative of the angular position changing at a rate exceeding a predetermined descent rate while the signal indicates rotation toward a rest position of the telescoping pivot arm, operate the actuator to reduce the length until the rate of change is less than the predetermined descent rate.

A weight training system includes a telescoping pivot arm comprised of a concentric arrangement of an outer tube and an inner tube and configured to pivot about an axis and receive a weight at a predetermined position. The weight training system further includes an actuator attached to the telescoping pivot arm and configured to cause relative motion between the inner tube and the outer tube to change a length between the predetermined position and the axis. The weight training system further includes a sensor configured to output a signal indicative of an angular position of the telescoping pivot arm about the axis. The weight training system further includes a controller programmed to operate the actuator to cause the length to change based on the signal to achieve a target resistance profile and, in response to a rate of change of the signal being indicative of the angular position changing at a rate less than a predetermined lift rate while the signal indicates rotation away from a rest position of the telescoping pivot arm and within a predetermined angular position range from the rest position, operate the actuator to reduce the length until the rate of change is greater than the predetermined lift rate.

The predetermined lift rate may be a rate indicative of a stall condition during a lift phase of a repetition. The controller may be further programmed to, in response to the rate of change of the signal being indicative of the angular position changing at a rate exceeding a predetermined descent rate while the signal indicates rotation toward the rest position, operate the actuator to reduce the length until the rate of change is less than the predetermined descent rate. The predetermined angular position range may be less than a total angular travel range measured during at least one previous repetition. A maximum angular position of the predetermined angular position range may be a predetermined percentage less than a peak angular position of the total angular travel range that is derived from the signal measured during at least one previous repetition as an angular position value at which the angular position stops increasing. A minimum angular position of the predetermined angular position range may be a predetermined percentage greater than a starting angular position of the total angular travel range that is derived from the signal during at least one previous repetition as an angular position value at which the angular position stops decreasing. The predetermined angular position range may be a predetermined percentage of the total angular travel range.

A weight training apparatus includes a telescoping pivot arm comprised of a concentric arrangement of an outer tube and an inner tube and configured to pivot about an axis and receive a weight at a predetermined position. The weight training apparatus further includes an actuator attached to the telescoping pivot arm and configured to cause relative motion between the inner tube and the outer tube to change a length between the predetermined position and the axis. The weight training apparatus further includes a sensor configured to output a signal indicative of an angular position of the telescoping pivot arm about the axis. The weight training apparatus further includes a controller programmed to operate the actuator to cause the length to change based on the signal to achieve a target resistance profile, estimate the length based on a control signal provided to the actuator, and output, to a display, an average over a predetermined number of repetitions of a force value that is based on the length and the angular position derived from the signal.

The controller may be further programmed to receive, from a user interface, a weight value that is indicative of a force due to gravity of the weight located at the predetermined position and wherein the force value is further based on the weight value.

DETAILED DESCRIPTION

Figure 1:
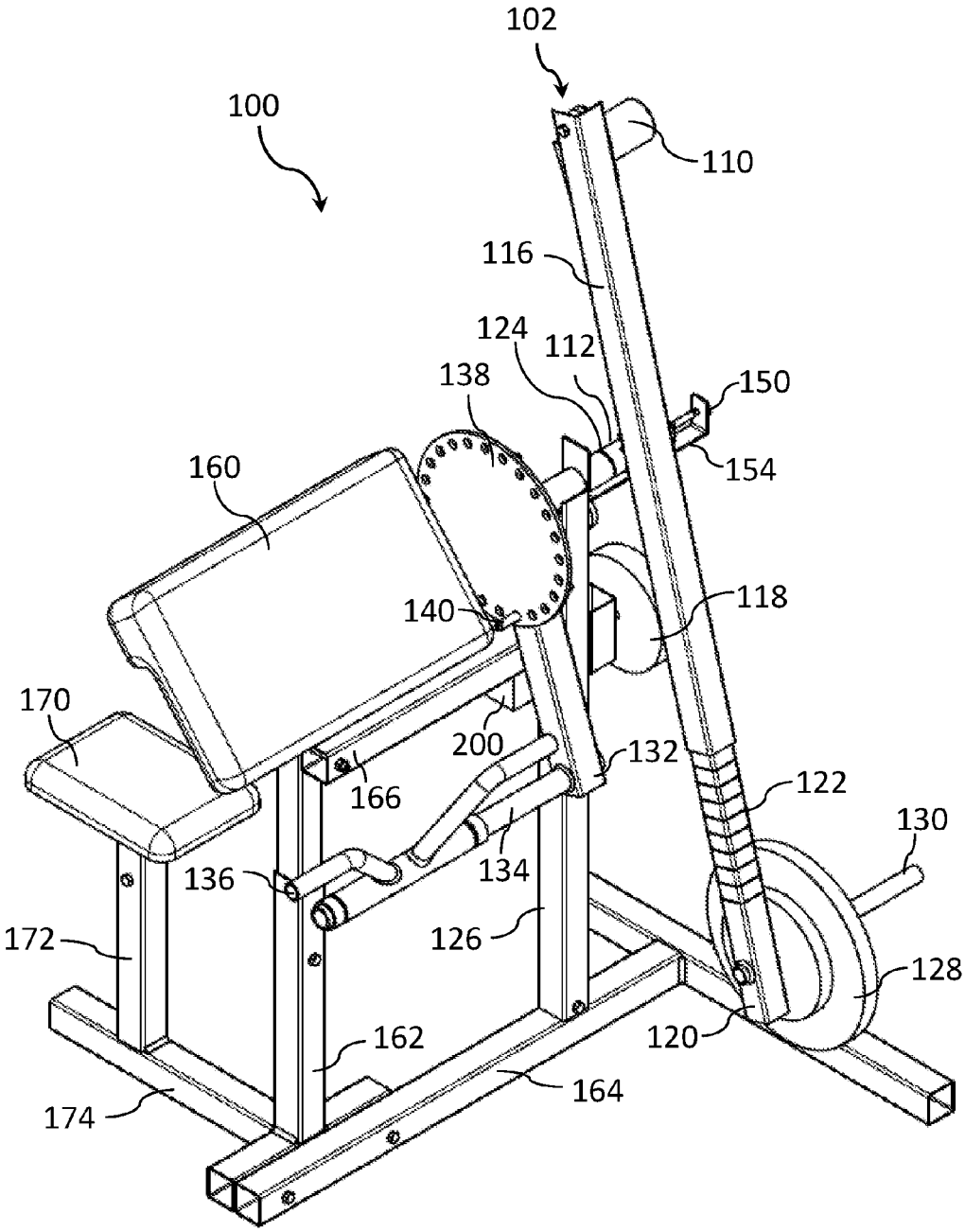
FIG. 1 is a front oblique view of a preacher arm curl apparatus at a bottom of a repetition and in an extended state.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

An issue during a weight training session is the onset of muscle fatigue leading to a person being unable to complete a set of repetitions. It is commonly accepted that maximum muscle growth occurs during the last few repetitions of the set when the muscle is fully exhausted. The ability to vary the weight in real time during a set allows the user to continue deeper into the muscular exhaustion and growth. A person lifting weights may enlist the aid of a spotter to help lift or hold the weight when muscle fatigue sets in.

Many weight trainers prefer to use weight plates over systems like hydraulic, pneumatic, spring, or brake systems that feel unnatural during the exercise. Direct movement of the weight without the use of cable systems to transfer the force gives the lifter a more direct feeling of being integrated with the weight. To weight trainers, this direct, non-cable solution is closest to the 'pumping iron' feel. Many systems presently use cable systems.

Many devices exist for performing push/pull types of exercise such as the squat, leg press, or bench press. Devices for rotational exercises such as arm curls, leg extensions, and leg curls generally involve complicated and expensive pulley/cable systems to connect the push/pull equipment to the rotational actuation device.

The weight training system described herein uses the principle of leverage and can utilize weight plates that the user may already own. Further, the system described can detect user fatigue and provide a spotter function to reduce the resistance when fatigue is detected. The system described herein can also vary the resistance during an exercises session to provide a more varied workout. The system can also be adapted for use with a cable-based weight stack system. The system may also be adapted to different weight training devices that may target different muscles.

The system herein is configured to provide an electronic feedback loop to automatically vary the resistance based on real-time measurements including speed of the lift, stall detection, total repetitions, force applied, and/or energy exerted. A common performance metric for weight trainers is the number of exercise cycles, iterations, or repetitions (or 'reps') expressed as a discrete integer. These discrete integer performance metrics make it difficult for the user to observe progress over a short term. For example, the number of exercise cycles does not consider the resistance level during the exercise cycle. The system described herein is also configured to calculate the average force and energy lifted over the set to provide a continuous performance metric. Such a continuous performance metric provides a better indication of progress than the number of exercise cycles.

FIG. 1 depicts one possible configuration of the dynamically adaptive direct lift weight machine in the form of a preacher arm curl apparatus 100. The preacher arm curl apparatus 100 includes a pivoting arm 102. The pivoting arm 102 is configured to pivot about an axis defined by a pivot axis member 124. The axis defined by the pivot axis member 124 may be referred to as the pivot axis. The pivot axis member 124 may be a cylindrical shaft. In some configurations, the shaft may be contained within a cylindrical housing to prevent exposure of the rotating shaft. Depending on the particular characteristics (e.g., strength, durability) of material used, the pivot axis member 124 may be hollow or solid. The pivoting arm 102 may cooperate with the pivot axis member 124 to pivot about the pivot axis. For example, the pivoting arm 102 may be rigidly coupled to the pivot axis member 124 such that rotation of the pivot axis member 124 causes rotation of the pivoting arm 102.

The pivoting arm 102 may be comprised of an actuator guide arm 116 and an actuator travel arm 120. The actuator guide arm 116 may include an actuator guide pivot 112 that is concentric to and securely coupled to the pivot axis member 124. The actuator guide pivot 112 may be positioned on the pivoting arm 102 in a position approximately midway between ends of the pivoting arm 102.

The pivoting arm 102 may be configured as a telescoping device such that the length of the pivoting arm 102 may be varied. The actuator guide arm 116 and the actuator travel arm 120 may be configured as concentric tubes. Although shown in FIG. 1 as having a square cross section, a circular or other type of cross section may also be used. The actuator travel arm 120 may be configured to be of smaller cross-sectional dimension than the actuator guide arm 116. As such, the actuator travel arm 120 may be configured to be containable by or nestable in the actuator guide arm 116. An inner cross-sectional dimension of the actuator guide arm 116 may be configured to be slightly greater than an outer cross-sectional dimension of the actuator travel arm 120 to allow the actuator travel arm 120 to slide within the actuator guide arm 116. In the configuration depicted, the actuator travel arm 120 may be a solid or hollow member while the actuator guide arm 116 is hollow to receive the actuator travel arm 120. In some configurations, the actuator guide arm may be containable or nestable in the actuator travel arm.

A weight support bar 130 may be coupled to the actuator travel arm 120 at a position near a first end of the actuator travel arm 120. The weight support bar 130 may extend generally perpendicular to the actuator travel arm 120. The weight support bar 130 may be configured to receive one or more weight plates 128. In some configurations, the weight support bar 130 may include a threaded portion configured to receive a screw-on weight retainer to secure the weight plates from movement relative to the weight support bar 130.

The actuator travel arm 120 may include graduation marks 122 that are configured to provide a visual indication of the position of the actuator travel arm 120 relative to the actuator guide arm 116. In some configurations, the graduation marks 122 may be etched onto an outer surface of the actuator travel arm 120. In some configurations, the graduation marks 122 may be painted onto an outer surface of the actuator travel arm 120. In addition, numerical designations associated with some of the graduation marks 122 may be printed or etched on the outer surface of the actuator travel arm 120.

Figure 8:
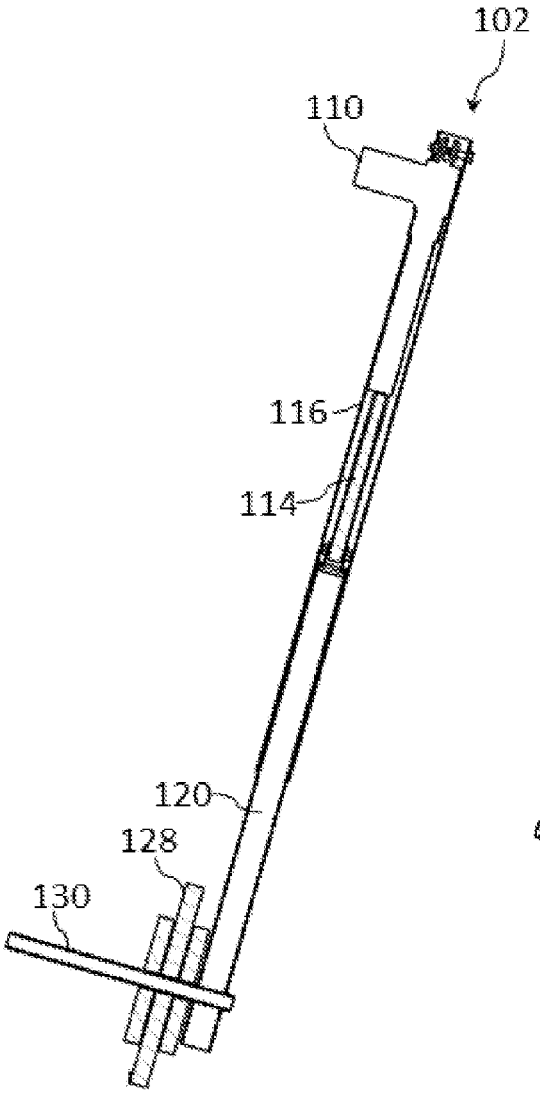
FIG. 8 is a cross-sectional view of a pivoting arm in an extended state.
Figure 9:
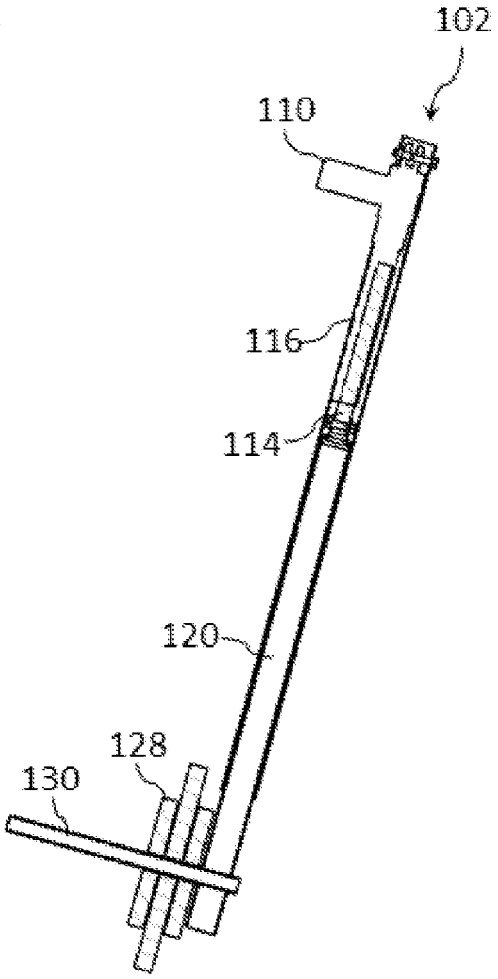
FIG. 9 is a cross-sectional view of a pivoting arm in a retracted state.

The actuator travel arm 120 may be configured to be retractable and extendable relative to the actuator guide arm 116. FIGS. 8 and 9 depict a possible configuration of the pivoting arm 102 in an extended and retracted position, respectively. A linear actuator 110 may be coupled to the actuator guide arm 116. The linear actuator 110 may include an electric motor powered by electrical energy. The linear actuator 110 may include a linear actuator arm 114 that is configured to move relative to the electric motor. The linear actuator arm 114 may be coupled to the actuator travel arm 120. The electric motor may be DC motor in which a DC voltage is applied to cause rotation of the motor shaft. The electric motor may be operated by applying a voltage across terminals of the electric motor. The electric motor may be rotated in a first direction by applying a positive voltage across the terminals. The electric motor may be rotated in a second direction, opposite the first direction, by applying a negative voltage across the terminals. Generally, by reversing the polarity of the applied voltage, the direction of rotation changes. In other examples, a stepper motor, an induction motor, a permanent magnet (PM) motor or other type of motor may be utilized. Selection of a different type of electric motor may impact the selection of the electronics and controls to operate the electric motor.

The linear actuator 110 may include an associated rotational to translational motion conversion mechanism to convert rotational motion of the electric motor into translational motion of the linear actuator arm 114. Examples may include a rack and pinion mechanism, a worm gear, a ball screw, a roller screw, or a leadscrew. Motion of the linear actuator arm 114 causes motion of the actuator travel arm 120. The electric motor may cause motion of the linear actuator arm 114 in a direction that extends and retracts the actuator travel arm 120 relative to the actuator guide arm 116. For example, rotation of the electric motor shaft in a first direction (e.g., clockwise) may cause the linear actuator arm 114 to move in a first direction to extend the actuator travel arm 120. Rotation of the electric motor shaft in a second direction opposite the first direction (e.g., counter-clockwise) may cause the linear actuator arm 114 to retract the actuator travel arm 120. A variety of linear actuators are commercially available. For example, U.S. Pat. No. 9,506,542, herein incorporated by reference, depicts and describes a representative linear actuator that may be utilized in the present application. An example of a commercially available linear actuator is model number LA-04 from Tampa Motions Company for which the product specification is hereby incorporated by reference. A representative application may utilize the LA-04 with a stroke size of ten inches.

As depicted in FIG. 8 and FIG. 9, the linear actuator 110 may be depicted as a unit to depict the function during extension and retraction. FIG. 8 depicts a state in which the linear actuator arm 114 is extended from the linear actuator 110. FIG. 9 depicts a state in which the linear actuator arm 114 is retracted within the linear actuator 110. For example, the linear actuator travel arm 114 may be a screw-type mechanism that moves relative to the linear actuator 110 as a cooperating mechanism powered by a drive unit within the linear actuator 110 is rotated. The linear actuator 110 may be configured so that the present position is maintained when no electrical energy is applied to the linear actuator 110. In the configuration depicted, the drive unit (e.g., electric motor, gearbox) of the linear actuator 110 may be attached to the actuator guide arm 116. The linear actuator travel arm 114 of the linear actuator 110 may be coupled to the actuator travel arm 120 such that the actuator travel arm 120 moves with the linear actuator travel arm 114. The linear actuator 110 may cause relative motion between the actuator guide arm 116 and the actuator travel arm 120 when the linear actuator 110 is actuated.

Power may be supplied to the linear actuator 110 via the linear actuator motor wires that are coupled to the terminals of the electric motor. Rotary motion of the electric motor is translated to translational motion by the linear actuator 110. For example, application of a positive voltage to terminals of the electric motor may cause the linear actuator arm 114 to extend the actuator travel arm 120 to an extended position (e.g., FIG. 8). Application of a negative voltage to terminals of the electric motor may cause the linear actuator arm 114 to retract the actuator travel arm 120 to a retracted position (e.g., FIG. 9). Note that in different configurations, the voltage polarity and direction of motion relationships may be different. To prevent unintended motion of the actuator travel arm 120 during exercise the linear actuator 110 may be configured such that movement is allowed only when the electric motor is activated. For example, when there is no voltage difference across the terminals of the electric motor, the linear actuator arm 114 does not move. To achieve this, the linear actuator arm 114 may be a rigid member.

Referring again to FIG. 1, the arm curl apparatus 100 may further include a lift arm 132 that is coupled to the pivot axis member 124. The lift arm 132 may be coupled to the pivot axis member 124 through a lift arm position selector 138. The pivot axis member 124 may be rigidly coupled to the lift arm position selector 138. Rotation of the lift arm position selector 138 about the pivot axis may cause rotation of the pivot axis member 124. The lift arm position selector 138 may define a plurality of openings for insertion of a locking pin or lift arm position selector pin 140. In the configuration depicted, the lift arm position selector 138 is circular and defines openings near an outer circumference of the lift arm position selector 138 for receiving the lift arm position selector pin 140.

At or near a first end of the lift arm 132, the lift arm 132 may be configured to receive the pivot axis member 124 such that the lift arm 132 can rotate about the axis defined by the pivot axis member 124. That is, the lift arm 132 may not be directly rigidly coupled to the pivot axis member 124. The lift arm 132 may define a locking pin receiver opening or cavity that is alignable with the openings defined by the lift arm position selector 138. When the locking pin receiver opening is aligned with one of the openings of the lift arm position selector 138, the lift arm position selector pin 140 may be inserted in the opening and through to the locking pin receiver opening of the lift arm 132. When the locking pin 140 is inserted and received by the locking pin receiver opening, the lift arm 132 and the lift arm position selector 138 may rotate about the pivot axis together. This configuration allows an angle between the lift arm 132 and the pivoting arm 102 to be adjusted. The adjustable angle allows users of different arm lengths to utilize the apparatus in a comfortable manner. In addition, varying of the angle may modify the resistance profile during an exercise cycle.

A lift bar 134 may be coupled to the lift arm 132 near a second end of the lift arm 132. A lift handle 136 may be rotatably coupled to the lift bar 134 such that the lift handle 136 may rotate about an axis defined by the lift bar 134. For example, the lift handle 136 may include a hollow tube that is installed concentrically with the lift bar 134. The lift handle 136 may be configured to move laterally along the lift bar 134 within a predetermined range. The lift handle 136 is operated by the user during an exercise session. The lift handle 136 may include a padded and/or resilient portion to facilitate a comfortable and secure grip on the lift handle 136.

The arm curl apparatus 100 may include a base cross support 164 that is configured to rest on the ground or other floor surface. The base cross support 164 may include adjustable feet at various locations to facilitate leveling of the arm curl apparatus 100. The base cross support 164 depicted is T-shaped and is not intended to limit the shape. Other shapes may be implemented.

A first end of a pivot support upright 126 may be coupled to the base cross support 164 and include a pivot axis support member at an opposite end. The pivot axis support member may be configured to receive the pivot axis member 124 such that the pivot axis member 124 may rotate relative to the pivot axis support member. The pivot axis support member may include a bearing to facilitate motion of the pivot axis member 124 relative to the pivot axis support member. The interface between the pivot axis member 124 and the pivot axis support member may include lubrication.

The arm curl apparatus 100 may include an arm support upright 162 that is configured to support and hold an arm support pad 160. A first end of the arm support upright 162 may be coupled to the base cross support 164. A second end, opposite the first end, of the arm support upright 162 may be coupled to the arm support pad 160. The arm support pad 160 may include a padded surface for the arms of the user to contact during exercise. For example, the arm support pad 160 may include a wood or metal substrate encased in padding material and a vinyl cover. An upper cross member support 166 may be coupled to the arm support upright 162 and the pivot support upright 126.

The arm curl apparatus 100 may include a seat support base 174 that is coupled to the base cross support 164. A first end of a seat support upright 172 may be coupled to the seat support base 174. A seat 170 may be coupled to a second end of the seat support upright 172. The seat 170 may be cushioned. In some configurations, the seat 170 and seat support upright 172 may be configured to provide a vertical and horizontal adjustment mechanism for the seat 170. The seat 170 is supported vertically through the seat support upright 172. The seat support base 174 may include adjustable feet to facilitate leveling. Coupling of the seat support base 174 to the base cross support 164 may be with bolts or welds.

The arm curl apparatus 100 may further include an actuator guide arm stop 118 that is coupled to the pivot support upright 126. The actuator guide arm stop 118 may be configured such that in a resting position, the pivoting arm 102 contacts an outer surface of the actuator guide arm stop 118. In some configurations, the actuator guide arm stop 118 is cylindrically shaped and the pivoting arm 102 rests tangentially along the surface of the actuator guide arm stop 118. The actuator guide arm stop 118 may include a layer of resilient material around a circumference to reduce noise and vibration when the pivoting arm 102 contacts the actuator guide arm stop 118. In some configurations, a switch or contact may be installed on the actuator guide arm stop 118. The switch may be configured to send an electrical signal when the pivoting arm 102 is contacting the actuator guide arm stop 118.

In some configurations, a position of the actuator guide arm stop 118 along the pivot support upright 126 may be changed. For example, the actuator guide arm stop 118 may be configured to be moved vertically along the pivot support upright 126. For example, openings may be defined in the pivot support upright 126 to receive a mounting post coupled to the actuator guide arm stop 118. The adjustable position allows the user to vary the resting position of pivoting arm 102.

An angular rotation sensor 150 may be coupled to the pivot axis member 124 to measure rotation of the pivoting arm 102. A body of the angular rotation sensor 150 may be coupled to the pivot support upright 126 with a mounting bracket 154.

During operation of the arm curl apparatus 100, the user may be positioned on the seat such that the user's elbows are resting on the arm support pad 160. The user may grasp the lift handle 136 with each hand. A comfortable grasp may be achieved without moving the lift bar 134 since the lift handle 136 can rotate about the lift bar 134. The user may pull upwards on the lift handle 136 which causes the lift bar 134 to lift upwards. Motion of the lift bar 134 is constrained to be about the pivot axis that is defined by the pivot axis member 124. As the user moves the lift bar 134 upward, the lift arm 132 that is coupled to the lift arm position selector 138 causes the lift arm position selector 138 to rotate about the pivot axis. The lift arm position selector 138 is coupled to the pivot axis member 124 so that the pivot axis member 124 also rotates. Since the actuator guide arm 116 is coupled to the pivot axis member 124, the actuator guide arm 116 rotates about the pivot axis as well.

The arm curl apparatus 100 provides a resistance to motion that depends on various factors. The weight of the weight plates 128 mounted on the actuator travel arm 120 affects the resistance. Further, the distance of the weight support bar 130 to the pivot axis (referred to as $d_1$) affects the resistance. Note that this distance, $d_1$, may be varied by operation of the linear actuator 110. The distance of the lift bar 134 from the pivot axis (referred to as $d_2$) also affects the resistance. In the configuration depicted, the distance, $d_2$, is fixed by placement of the lift bar 134 on the lift arm 132. In other configurations, the placement of the lift bar 134 on the lift arm 132 may be adjustable. To cause the pivoting arm 102 to rotate, a force of at least $F_w*d_1/d_2$ must be applied to the lift bar 134, where $F_w$ is the force applied perpendicular to the pivoting arm 102 at the weight support bar 130. Generally, the distance $d_1$ will be greater than the distance $d_2$ so that a gain factor is present. Due to the gain factor, the force applied by the user may be greater than the weight of the weight plates 128. A force greater than the minimum force may cause rotational acceleration of the pivoting arm 102. The distance from one element to another element may also be referred to as the length between the elements.

The linear actuator 110 may be configured to extend and retract to change the resistance or torque moment. The length of travel of the linear actuator arm 114 may be selected to provide a significant change in resistance. For example, a 40% to 50% change in resistance may be desired. For example, when fully extended, the distance between the pivot axis and the weight support 130 may be 28 inches. When fully retracted, the distance between the pivot axis and the weight support 130 may be 18 inches. In this example, a linear actuator 110 having a travel range of 10 inches may be selected. In addition, the rate of change of the position adjustment may be selected to respond quickly to length adjustment commands. For example, a linear actuator 110 in which the position can be adjusted at a rate of 40 mm/sec may be selected. The rate of change of the linear actuator arm 114 may be impacted by the power and torque capability of the electric motor associated with the linear actuator 110 as well as any gear ratios that may be involved.

The distance, $d_1$, of the weight support bar 130 to the pivot axis may be estimated or measured. In some configurations, a sensor may be included that provides a signal indicative of the position of the actuator travel arm 120 relative to the actuator guide arm 116. For example, a potentiometer coupled to the actuator guide arm 116 such that the shaft of the potentiometer is configured to rotate as the actuator travel arm 120 moves relative to the actuator guide arm 116. The shaft of the potentiometer may be fitted with a wheel or roller in contact with the actuator travel arm 120. In other configurations, the position may be estimated based on the current applied to the linear actuator 110 and the amount of time that the current is applied.

The resistance or torque moment about the pivot axis due to the weight plates 128 is a function of the applied weight, the relative angle of the pivot arm from horizontal, and the distance of the weight support bar 130 from the pivot axis. The torque moment about the pivot axis is caused by the force perpendicular to the pivot arm 102 caused by the mounted weight. The torque moment at the pivot axis may be a maximum when the pivoting arm 102 is in a horizontal position relative to the ground. The torque to maintain the pivoting arm in a horizontal position is a product of the applied weight and the distance of the weight from the pivot point (e.g., $d_1$). At the horizontal position, the only force component is perpendicular to the pivoting arm 102.

As the pivoting arm 102 pivots away from the horizontal position, there is a force component perpendicular to the pivoting arm 102 and a force component along the pivoting arm 102. For example, if the pivoting arm 102 is rotated upward to a vertical position (ninety degrees from horizontal), there is only a force along the pivoting arm 102 and the torque moment at the pivot axis is zero. As such, precautions may be included to prevent the pivoting arm 102 from becoming completely vertical. A mechanical stop may be included that limits motion of the pivoting arm 102 above a certain angle to prevent the vertical position of the weight. At a given rotation angle relative to the horizontal position, the torque component acting perpendicular to the pivoting arm 102 may be expressed as a product of the applied weight and the cosine of the rotation angle.

If the weight support bar 130 remains a constant distance from the pivot axis, the torque moment at the pivot axis will vary. At the bottom position, the torque moment may be at a minimum. As the pivoting arm 102 is pivoted toward a topmost position, the torque moment may increase to a maximum as the pivoting arm 102 approaches the horizontal position. As the pivoting arm 102 passes the horizontal position, the torque moment again decreases. In one mode of operation, an electronic control unit (ECU) 200 may operate the linear actuator 110 to cause the pivoting arm 102 to extend and retract in such a way as to maintain a constant torque throughout the repetition.

A maximum possible resistance may be achieved when the linear actuator 110 is actuated to a fully extended position. A minimum possible resistance may be achieved when the linear actuator 110 is actuated to a fully retracted position. The extension range of the linear actuator 110 may be selected such that the resistance changes by a factor of 50% between the fully extended and fully retracted positions.

Figure 3:
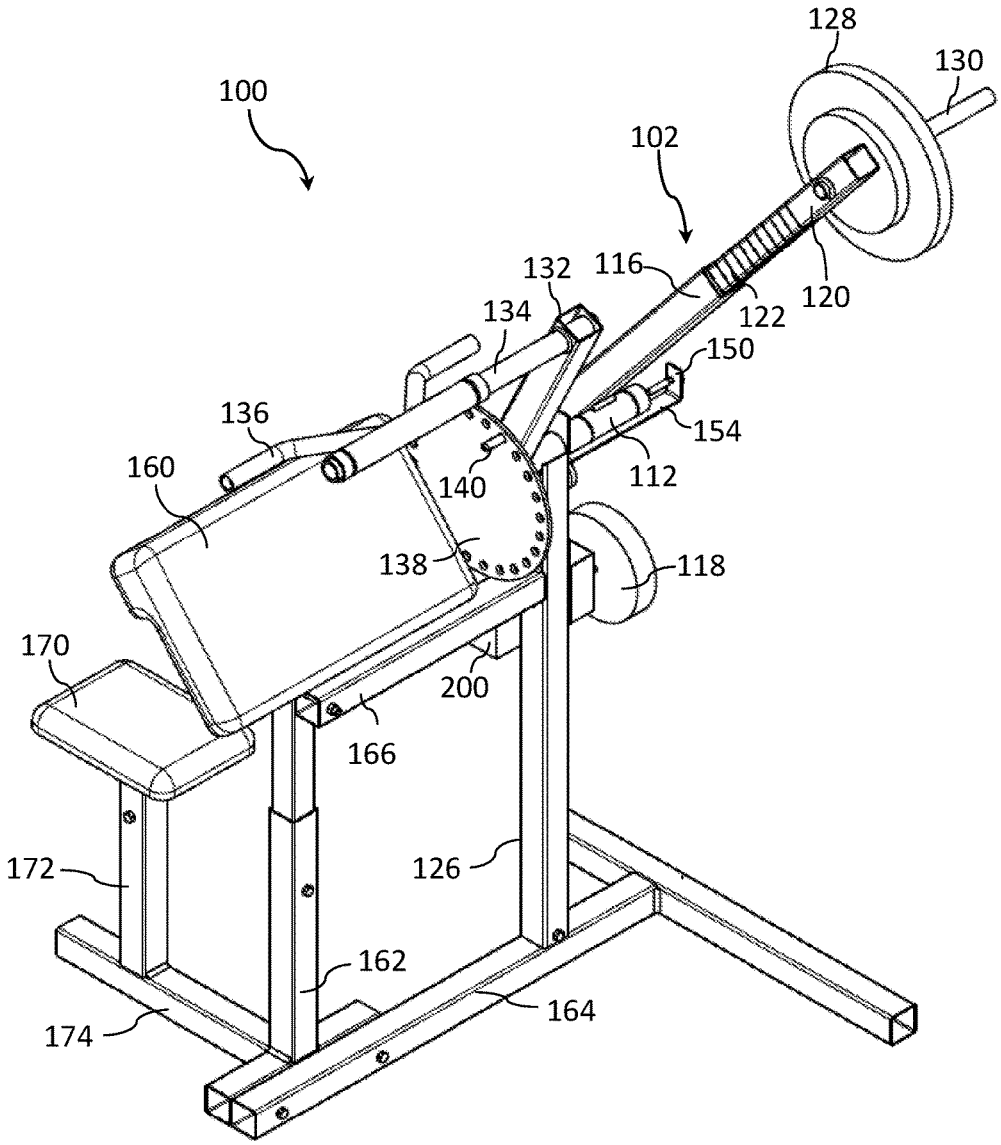
FIG. 3 is a front oblique view of a preacher arm curl apparatus at a top/lifted position of a repetition and in an extended state.

FIG. 1 and FIG. 3 depict the arm curl apparatus 100 in which the actuator travel arm 120 is in an extended position. FIG. 1 depicts the arm curl apparatus 100 during a resting state in which the pivoting arm 102 contacts the actuator guide arm stop 118. FIG. 3 depicts the arm curl apparatus 100 during an active state in which the pivoting arm 102 is moved by force applied to the lift bar 134. Note that the element descriptions provided in relation to a given figure are applicable to other figures that include the same numbered element.

Figure 2:
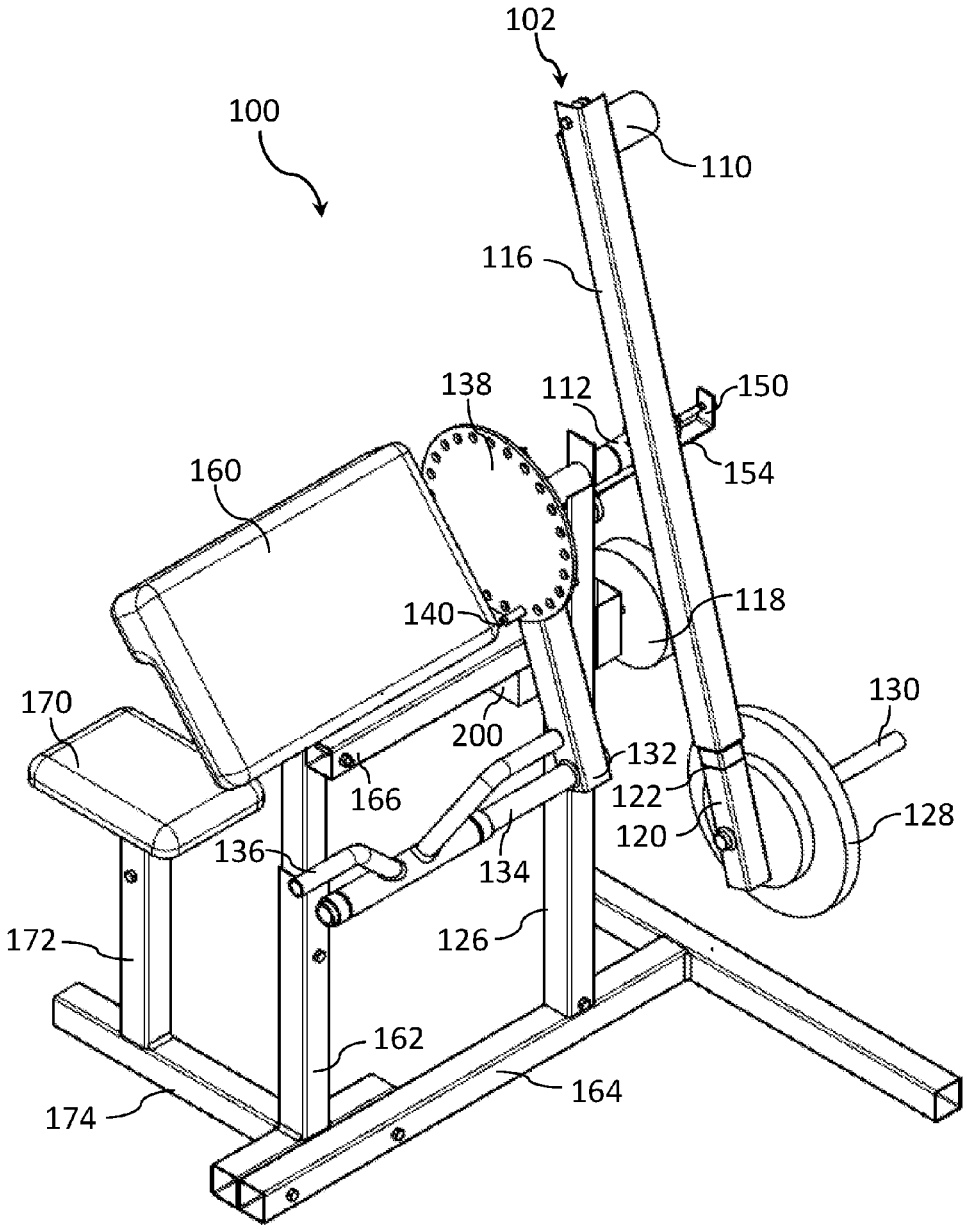
FIG. 2 is a front oblique view of a preacher arm curl apparatus at a bottom of a repetition and in a retracted state.
Figure 4:
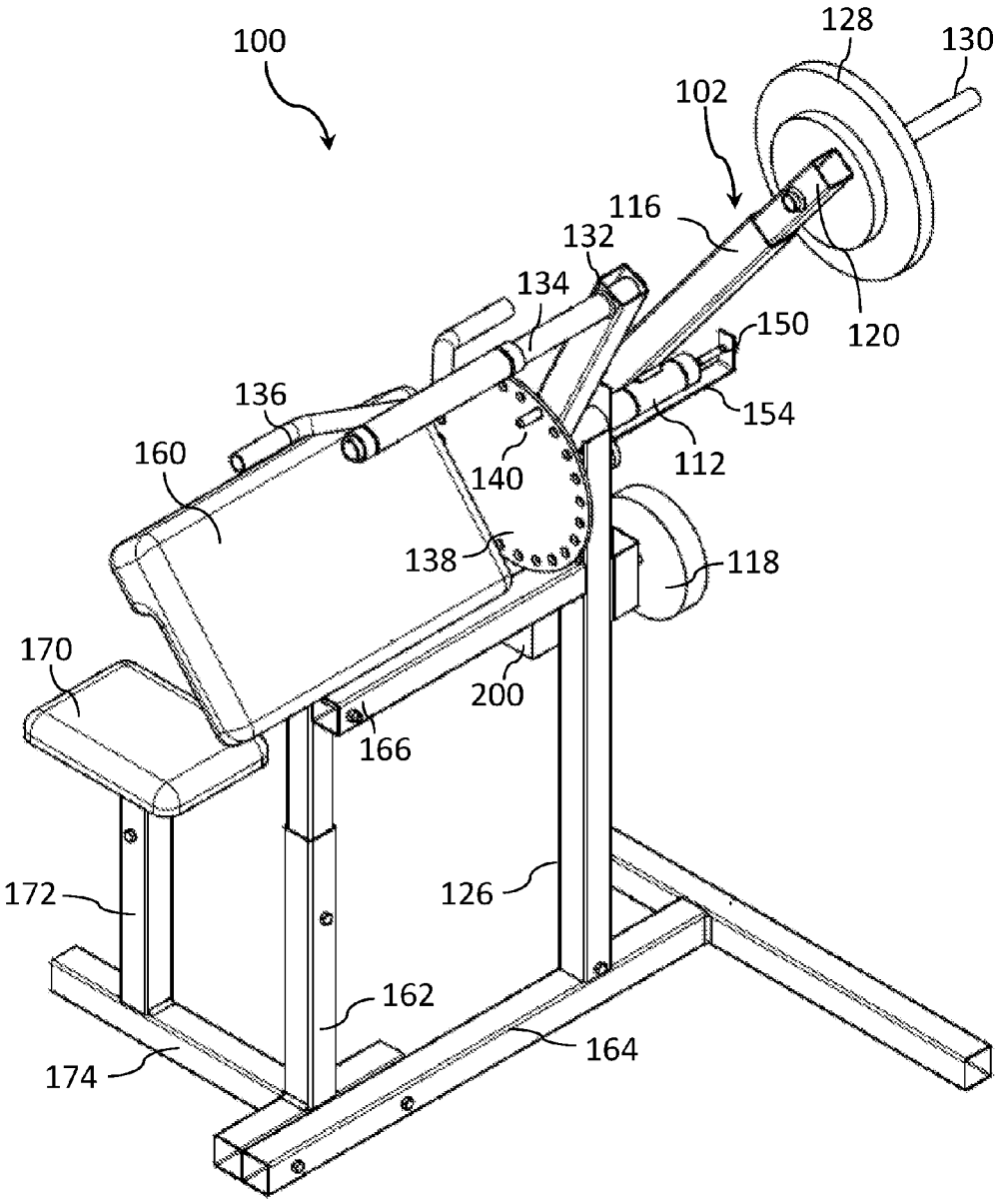
FIG. 4 is a front oblique view of a preacher arm curl apparatus at a top/lifted position of a repetition and in a retracted state.

FIG. 2 and FIG. 4 depict the arm curl apparatus 100 in which actuator travel arm 120 is in a retracted position. FIG. 2 depicts the arm curl apparatus 100 during a resting state in which the pivoting arm 102 contacts the actuator guide arm stop 118. FIG. 4 depicts the arm curl apparatus 100 during an active state in which the pivoting arm 102 is moved by force applied to the lift bar 134.

Figure 5:
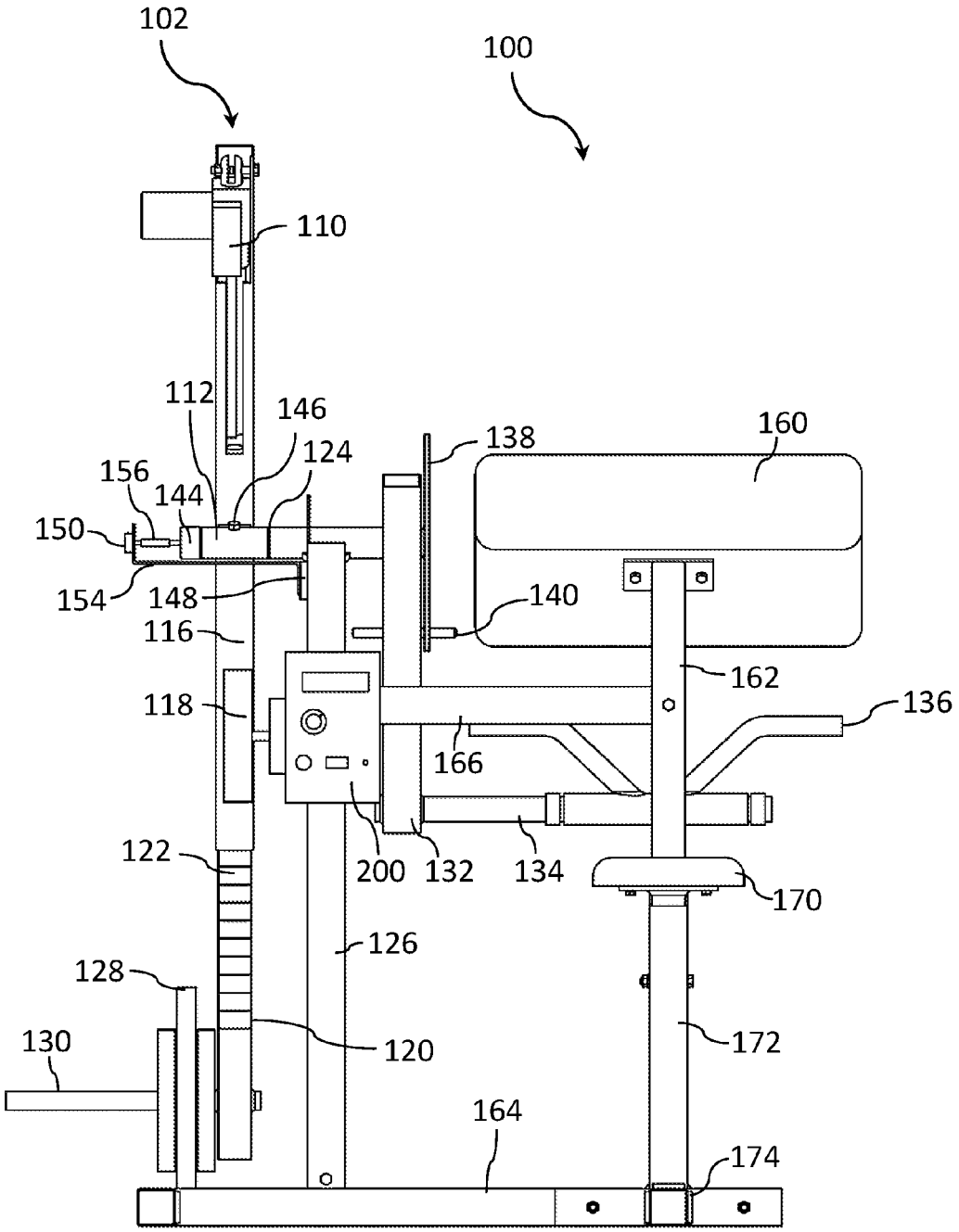
FIG. 5 is a rear view of a preacher arm curl apparatus at a bottom of a repetition and in an extended state.

FIG. 5 depicts a rear view of the arm curl apparatus 100 in which the actuator travel arm 120 is in an extended position during a resting state in which the pivoting arm 102 contacts the actuator guide arm stop 118.

Figure 6:
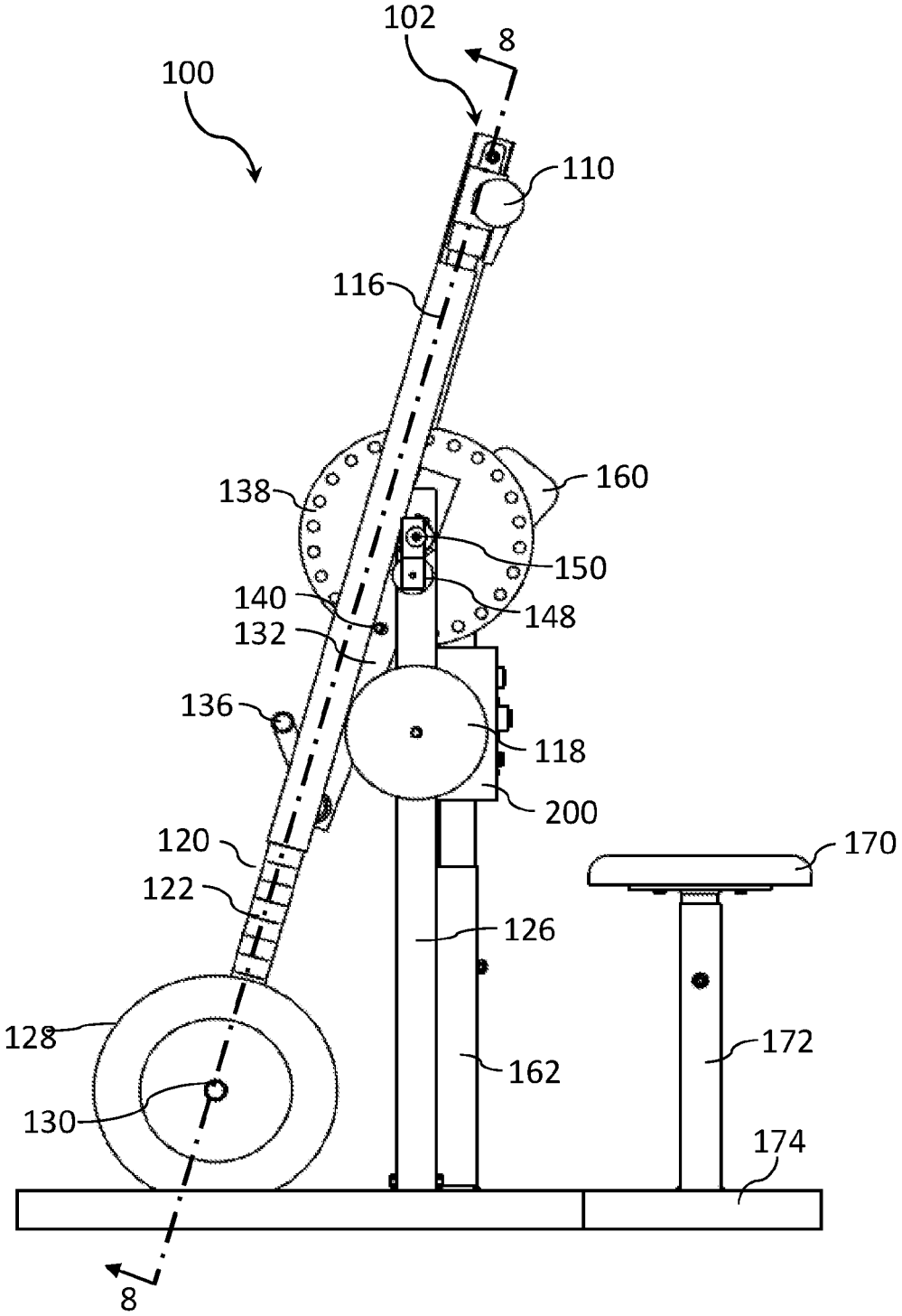
FIG. 6 is a side view of a preacher arm curl apparatus at a bottom of a repetition and in an extended state.
Figure 7:
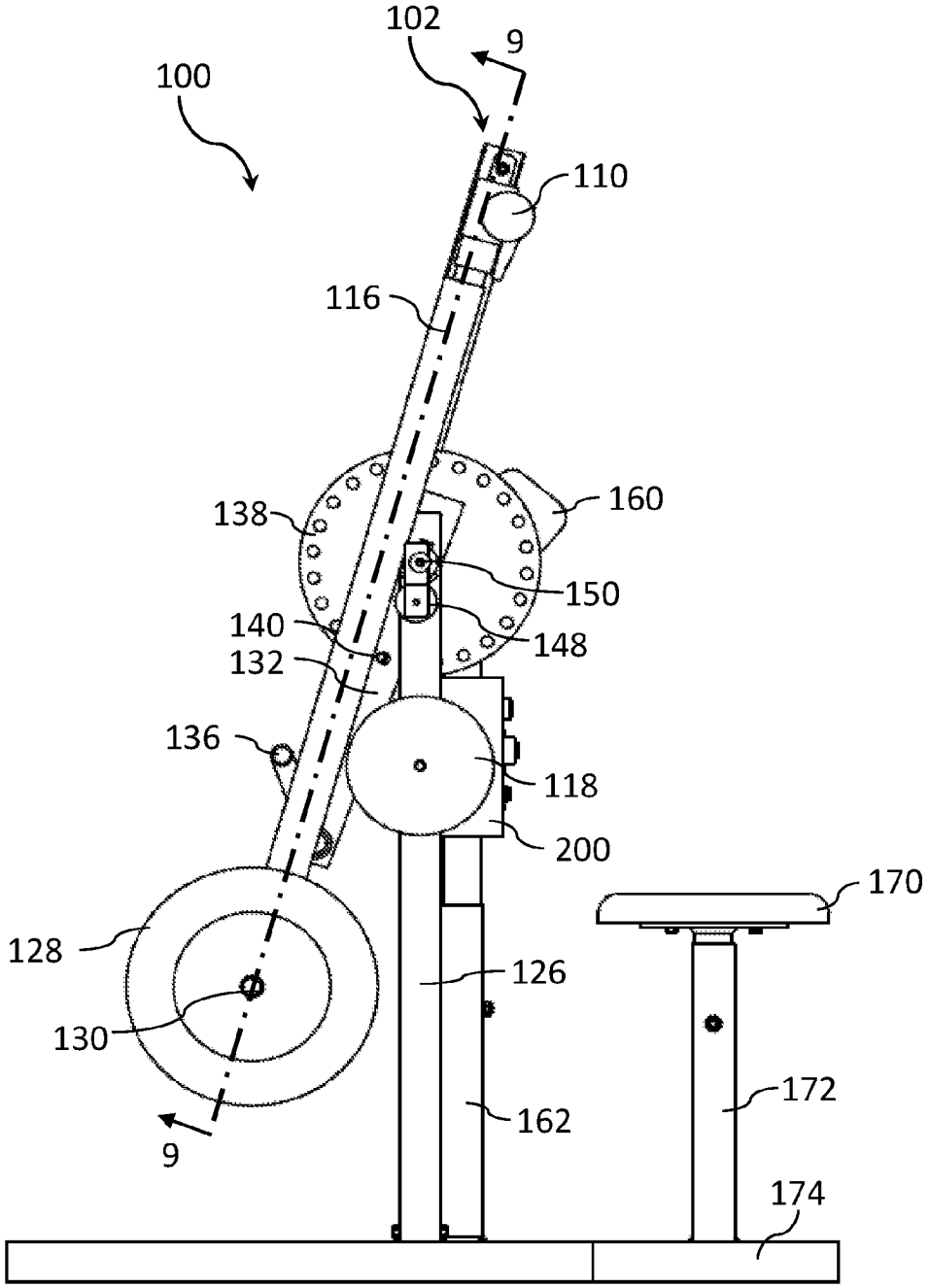
FIG. 7 is a side view of a preacher arm curl apparatus at a bottom of a repetition and in a retracted state.

FIG. 6 depicts a side view of the arm curl apparatus 100 in which the actuator travel arm 120 is in an extended position. FIG. 7 depicts a side view of the arm curl apparatus 100 in which the actuator travel arm 120 is in a retracted position. FIG. 6 and FIG. 7 also depicts the arm curl apparatus 100 during a resting state in which the pivoting arm 102 contacts the actuator guide arm stop 118.

Figure 11:
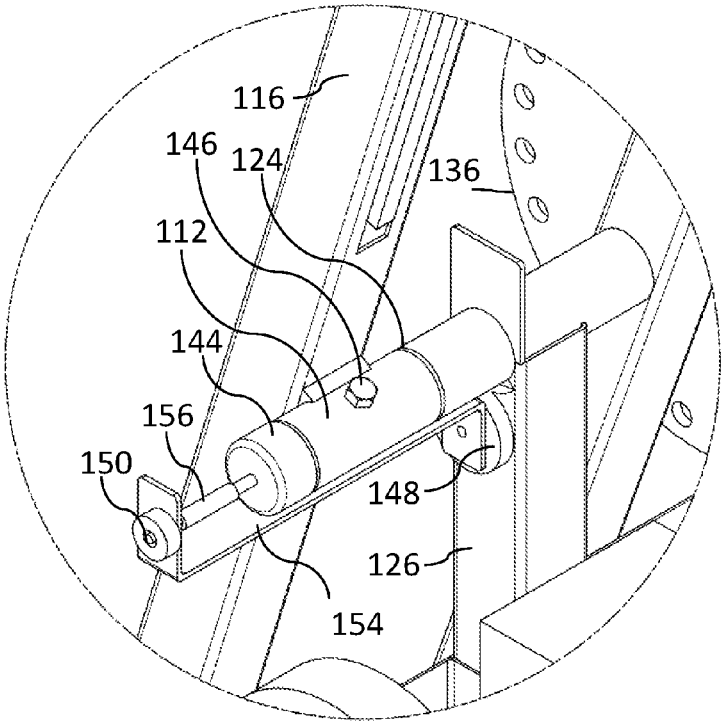
FIG. 11 is a close-up rear view of a preacher arm curl apparatus depicting the pivoting mechanism and an angle measurement system.
Figure 10:
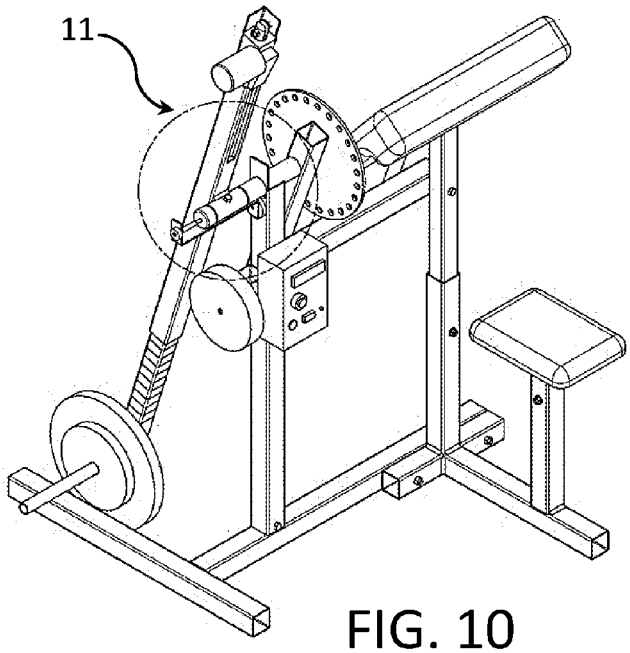
FIG. 10 is a rear oblique view of a preacher arm curl apparatus including a pivoting mechanism.

FIG. 10 and FIG. 11 depict further details regarding the pivot axis interface. FIG. 10 is a rear oblique view of the arm curl apparatus. FIG. 11 depicts an expanded view of the pivot axis interface. The actuator guide arm 116 may be coupled to the pivot axis member 124 via the actuator guide pivot 112. A pivot arm locking bolt 146 may secure the actuator guide pivot 112 to the pivot axis member 124 allowing the pivot arm 102 to rotate with the pivot axis member 124. An end cap 144 may be coupled to the pivot axis member 124.

The angular rotation sensor 150 may be coupled to the pivot axis member 124 to measure rotation of the pivoting arm 102. For example, a shaft of the angular rotation sensor 150 may be coupled to the pivot axis member 124 or the end cap 144. The end cap 144 may include a coupling shaft and a tube or coupling 156 may be secured to the shaft of the angular rotation sensor 150 and the coupling shaft using clamps. As the pivot axis member 124 rotates, the shaft of the angular rotation sensor 150 rotates to vary an output signal that is indicative of the angle of rotation (e.g., angular position of the telescoping pivot arm 102). Angular rotation sensor wires are used to electrically couple the angular rotation sensor 150 to a control device. The mounting bracket 154 may be coupled to the pivot support upright 126 via a fastener such as a bolt or screw. The mounting bracket 154 may be fastened to a magnet 148 which is then magnetically coupled to the pivot support upright 126.

The angular rotation sensor 150 may be a rotary potentiometer. In some configurations, the angular rotation sensor 150 may be an encoder or resolver. Any sensor configured to measure an angular position may be utilized. In some configurations, the angular rotation sensor 150 may be an accelerometer that is mounted on the pivoting arm 102 to provide a signal indicative of the angle of rotation of the pivoting arm 102. The accelerometer may be configured to measure the component of acceleration due to gravity that is perpendicular to the pivoting arm 102. As the angle of rotation changes, the force due to gravity in the perpendicular direction changes. The signal may be monitored and processed by a controller to generate an estimate of the angle of rotation of the pivoting arm.

The output of the angular rotation sensor 150 provides a signal indicative of the angular position of the pivoting arm 102. The angular position may be an angle relative to the resting position and may be referred to as a lift angle. Further, a speed of rotation may also be derived from the position signal. By differentiating the position signal an angular velocity of the pivoting arm 102 may be computed. In addition, a derivative of the angular velocity provides an angular acceleration of the pivoting arm 102. The position, velocity, and acceleration values may be used to control operation of the linear actuator 110. The control device receiving the output signal of the angular rotation sensor 150 may be programmed to compute the angular position, angular velocity, and angular acceleration values. A starting position of a repetition may be a position that is greater than the resting position of the telescoping pivot arm 102. Learning a starting position may begin when the angular position changes from the resting position of the telescoping pivot arm 102. For some configurations, the starting position of the repetition may be the same as the resting position of the telescoping pivot arm 102.

For example, when the angular rotation sensor 150 is a rotary potentiometer, the resistance of the potentiometer varies as the pivot axis member 124 rotates. The resistance value may be indicative of the relative angle of the pivoting arm 102 from the rest position. The rest position may be the position in which the pivoting arm 102 is resting on the actuator guide arm stop 118. By measuring the resistance value, the angle of pivoting arm 102 may be determined. A calibration procedure may be utilized to calibrate the resistance values for a given range of angles. The rotary potentiometer may have three electrical connections. A predetermined voltage may be applied across first and second electrical connections. An output signal may be provided by the third electrical connection that has a voltage that varies as the resistance changes during rotation. The output signal may be input to the control device.

The lift angle may be measured based on the angle at the bottom-most position when the pivoting arm 102 contacts the actuator guide arm stop 118. The base or minimum lift angle may be calibrated as zero degrees. The lift angles computed during an exercise cycle or repetition may be relative to the base lift angle. The angle between the base angle and the horizontal position may be estimated or determined via calibration. An exercise cycle may begin with the weight support bar 130 at the bottom-most position/angle. As the lift bar 134 is raised, the weight support bar 130 will move toward a top-most position/angle. During this interval, the lift angle should be increasing. That is, a present lift angle measurement should be greater than a previous lift angle measurement. Alternatively, the angular velocity should be a positive value. As the lift bar 134 is lowered, the weight support bar 130 will move toward the bottom-most position/angle. During this interval, the lift angle should be decreasing. That is, a present lift angle measurement should be less than a previous lift angle measurement. Alternatively, the angular velocity should be a negative value.

Figure 12:
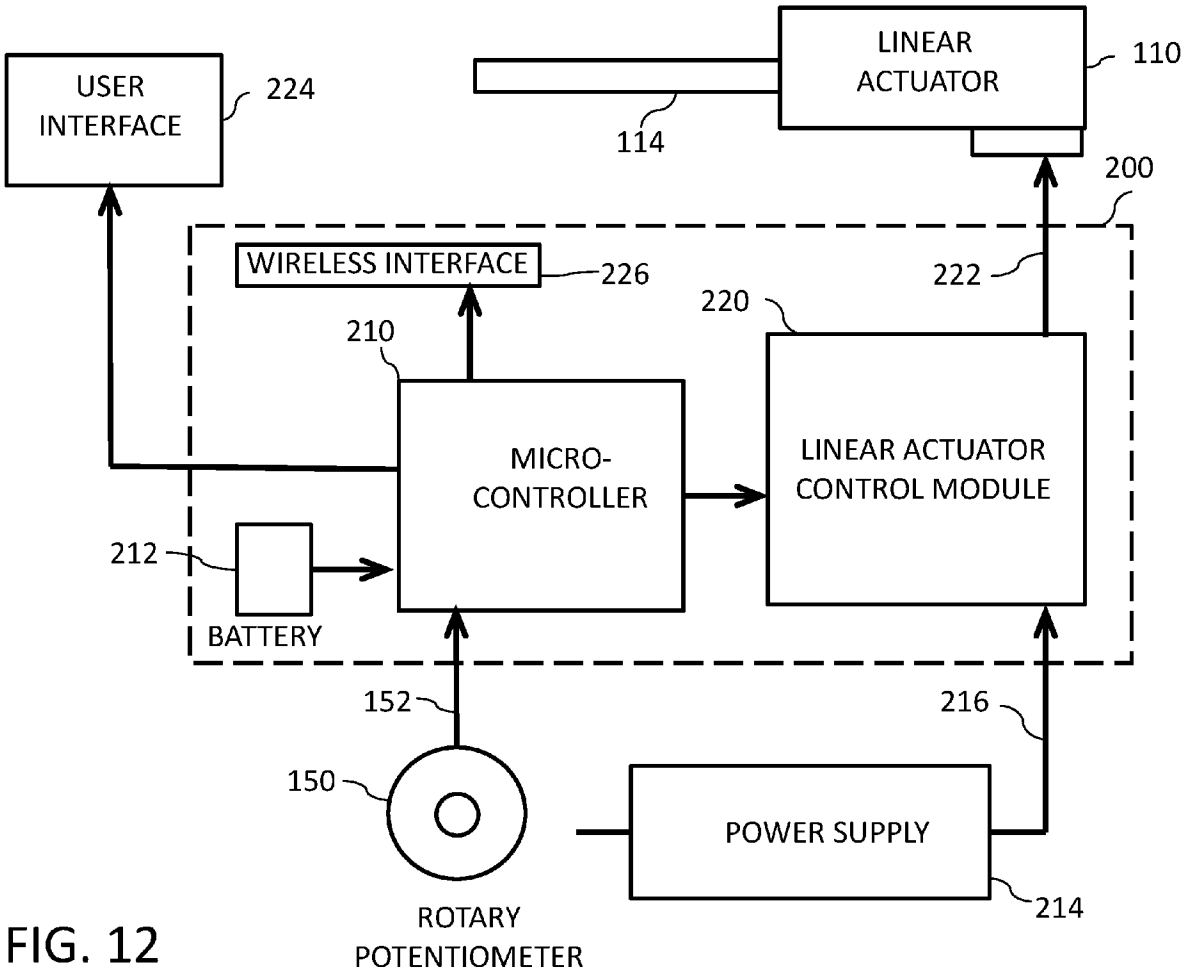
FIG. 12 is a diagram of an electronic control system.

FIG. 12 depicts an electronic control unit 200 and a user interface module 224 that may be used to control and monitor the exercise apparatus. The ECU 200 may include a microcontroller 210. The microcontroller 210 may be powered by a low voltage battery 212. In some configurations, the low voltage battery 212 may be a backup power source to permit operation and retention of data during power outages.

The ECU 200 may include a linear actuator control module 220 that is configured to operate the linear actuator 110. The linear actuator control module 220 may include switching devices for selectively switching power and return signals to linear actuator motor wires 222. For example, the switching devices may include relays and/or solid-state devices (e.g., bi-polar transistors, field-effect transistors, and/or complementary metal oxide semiconductors) to control voltage and current supplied to the linear actuator 110. In some configurations, integrated circuits may be utilized that include solid-state switching devices. The configuration of the linear actuator control module 220 may depend on the type of electric motor in the linear actuator 110 (e.g., DC, AC induction, etc.). The linear actuator control module 220 may receive power from a power supply 214. The power supply 214 may supply power via a power supply cable 216. For example, the power supply 214 may be an AC to DC converter that converts AC voltage from a power outlet to a predetermined DC voltage (e.g., 12 Volts). The power supply 214 may supply power to all components of the ECU 200.

The ECU 200 may include a wireless interface module 226 that is configured to provide wireless communication to external devices. The wireless interface module 226 may support wireless communication standards such as BLUETOOTH and/or wireless networking (Wi-Fi) as defined by Institute of Electrical and Electronics Engineers (IEEE) 802 family of standards (e.g., IEEE 802.11). The wireless interface module 226 may be configured to transfer data between the ECU 200 and a remote device such as phone, tablet and/or computer. The microcontroller 210 may be programmed to implement a communications protocol that is compatible with the supported wireless communication standards.

The ECU 200 may include a current sensor to measure current supplied to the linear actuator 110. A resistive network or a hall-effect current sensor may be used. The current sensor may provide a signal indicative of the magnitude and polarity of the current drawn by the linear actuator 110. The signal may be input to the microcontroller 210 for control and monitoring of the linear actuator 110. For example, the signal may be monitored to detect an end of travel of the linear actuator 110. When motion of the linear actuator arm 114 is constrained or inhibited (e.g., motion inhibited due to end of travel) the current may increase as the electric motor stops rotating. The current may be monitored to detect the end of travel range condition. When an end of travel range condition is detected, the microcontroller 210 may reduce the current command to the linear actuator 110. For example, a voltage across terminals of the linear actuator 110 may be commanded to zero. In some configurations, the linear actuator 110 may include limit switches that are configured to trigger at the maximum stroke of the linear actuator arm 114. The limit switches may be configured to reduce the current when the travel limits are reached to protect the electric motor of the linear actuator 110. For example, the limit switch may interrupt the flow of current to the electric motor when triggered by contact.

Additionally, the magnitude of the current required to move the linear actuator 110 may be indicative of the amount of weight placed on the weight support bar 130. As the weight increases, the amount of current needed to move the actuator travel arm 120 may increase. A table of current values and weight values may be stored in non-volatile memory to determine the weight according the measured current. The table may be predefined based on calibration values.

The ECU 200 may include a voltage sensor to measure the voltage applied to the linear actuator 110. For example, a resistive network may be used. The voltage sensor may provide a signal indicative of the magnitude and polarity of the voltage applied to the linear actuator 110. The signal may be input to the microcontroller 210 for control and monitoring of the linear actuator 110.

The ECU 200 may include a connection interface that allows electrical connection of the various components. In some configurations, the electrical connections may be hard-wired via connectors. For example, the angular rotation sensor wires 152 may be routed to the connection interface for input into the microcontroller 210. In some configurations, angular rotation sensor wires 152 may be routed directly to the microcontroller 210. In some configurations, conductors from the switch mounted on the actuator guide arm stop 118 may be routed to the connection interface. All sensors described herein may be electrically coupled via the connection interface. The connection interface may also include interface circuitry to scale and/or isolate input and output signals.

The microcontroller 210 may provide output signals to control the switching devices of the linear actuator control module 220. The microcontroller 210 may include one or more analog-to-digital (A/D) channels to convert the various input signals from analog to digital form. For example, A/D channels may be used for signals from the angular rotation sensor 150, the voltage sensor, and the current sensor. The microcontroller 210 may include a processor for executing instructions and volatile and non-volatile memory for storing data and programs. The microcontroller 210 may include various timer/counter inputs for processing data from other sensors.

The user interface 224 may be a dedicated user interface that is coupled to the exercise apparatus. The user interface 224 may include a display for outputting information to the user. The user interface 224 may include an input module. The input module may be configured to allow user input for configuring the exercise machine. For example, physical buttons may be included that allow the user to select various features. In some configurations, the user interface 224 may be a touch screen that allows display and input of information. The user interface 224 may be controlled and monitored by the microcontroller 210. In some configurations, the user interface 224 may include a dedicated microprocessor and communication with the microcontroller via serial data link. The user interface 224 may be configured to allow the user to selectively retract and extend the actuator travel arm 120 manually via menus or button presses. For example, pressing a retract button may cause the actuator travel arm 120 to retract while the retract button is pressed.

In other configurations, the user interface 224 may be a remote device. Communication between the microcontroller 210 and the user interface 224 may be via the wireless interface module 226. For example, an application may be executed on a tablet or smart phone that allows display of information to the user and allows the user to configure the exercise machine.

The ECU 200 may be utilized to monitor and control an exercise session. The ECU 200 may be programmed to extend and retract the actuator travel arm 120 by commanding the linear actuator 110. During an exercise session, the user may struggle to raise the pivoting arm 102 due to muscle fatigue or weakness. The microcontroller 210 may be programmed to detect a stall condition in which the user can no longer lift the weight. A stall condition may be identified as a condition in which the lift angle is increasing at a rate that is lower than a predetermined rate while the lift angle is within a predetermined range. If a stall condition is detected, the microcontroller 210 may be programmed to reduce the weight by controlling the linear actuator 110. For example, the linear actuator 110 may be controlled to position the actuator travel arm 120 in a fully retracted position. The linear actuator 110 may also be controlled to retract the actuator travel arm 120 until the lift angle begins to increase again.

The microcontroller 210 may be programmed to actuate the linear actuator 110 to achieve a selected resistance profile. Various open-loop and closed-loop strategies are available to achieve a selected resistance. Open-loop examples include monitoring the current and actuation time during operation of the linear actuator 110.

The weight profile may be expressed as target weights associated with lift angles. The weight profile may be defined over a selectable number of exercise cycles. In addition, the weight profile may change for each exercise cycle. For example, to maintain a constant resistance during an exercise cycle, the target weight may be varied for each lift angle. The target weight may be translated to a target position of actuator travel arm 120. A table of actuator travel arm 120 positions indexed by lift angle may be computed and stored.

The position of the actuator travel arm 120 may be estimated or measured. During the exercise cycle, the linear actuator 110 may be operated to achieve the target position that may vary during an exercise cycle. For example, an amount of travel of the actuator travel arm 120 may be previously characterized as a set of current/voltage magnitudes and associated actuation times. During operation, the microcontroller 210 may compute the amount of travel necessary and apply an associated current/voltage for a corresponding time. In other configurations, the position of the actuator travel arm 120 may be measured and this feedback may be used to control the voltage/current applied to the linear actuator 110. For example, a proportional-integral (PI) control strategy may be implemented by the microcontroller 210.

Figure 13:
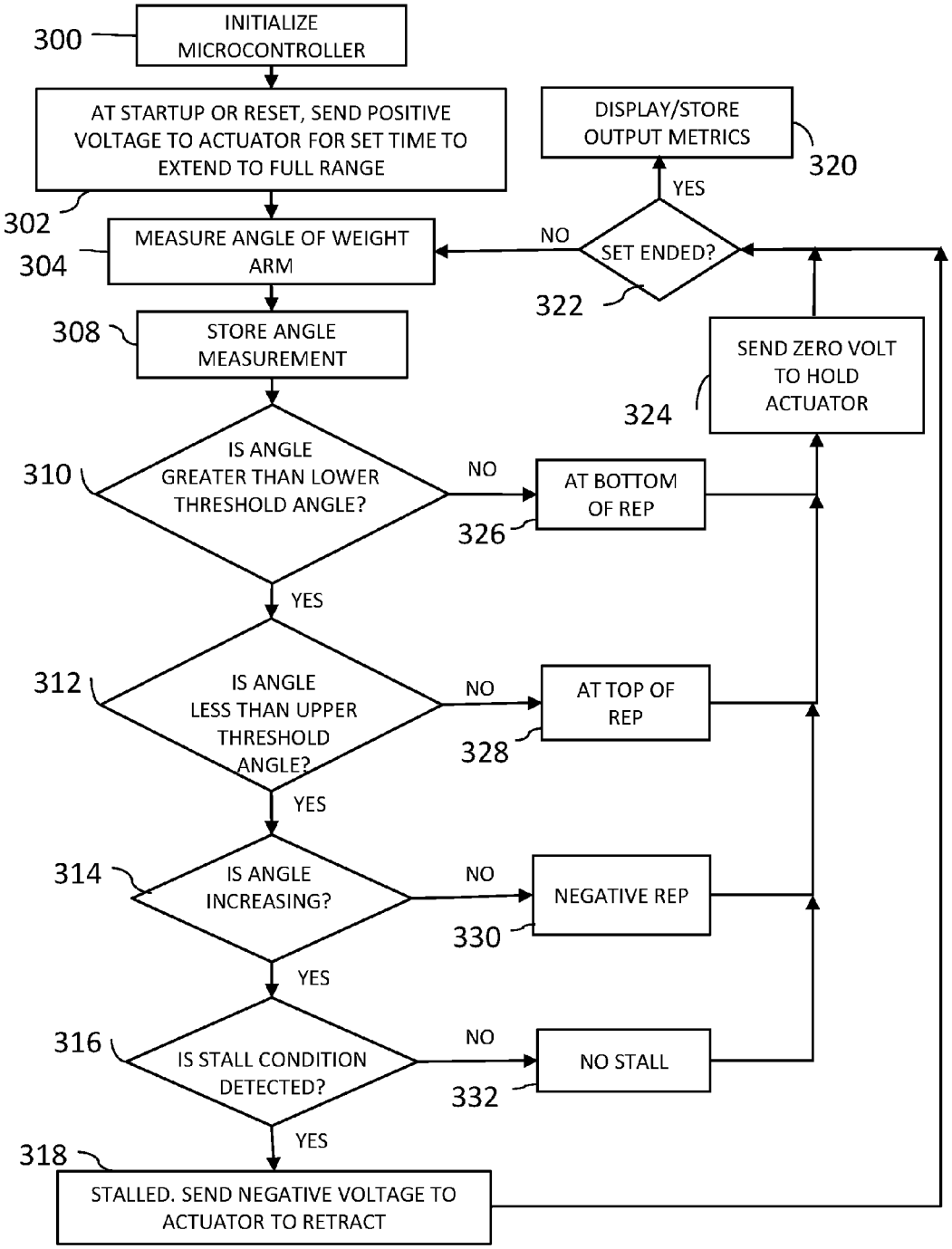
FIG. 13 is a possible logic flowchart depicting operations performed by the electronic control system for controlling operation of the mechanism.

FIG. 13 depicts a flowchart for a possible sequence of operations that may be implemented in the microcontroller 210 to detect and manage a stall condition. At operation 300, the microcontroller 210 may be initialized. Instructions may be executed to initialize variables for an exercise session. At operation 302, a positive voltage may be applied to the linear actuator 110 for a predetermined time (e.g., 5 seconds) to fully extend the actuator travel arm 120. In general, a voltage may be applied to place the actuator travel arm 120 in a predetermined position. The particular voltage pattern may depend on the present position of the actuator travel arm 120 and the target position of the actuator travel arm 120.

At operation 304, the lift angle of the pivoting arm 102 may be measured by sampling the signal from the angular rotation sensor 150. The measured lift angle may be an angle relative to the resting angle. The resting angle of the pivoting arm 102 (e.g., angle measurement when pivoting arm 102 contacts the actuator guide arm stop 118) may be known and stored in the microcontroller 210. At operation 308, the lift angle measurement may be stored in controller memory. For example, a buffer of lift angle measurements may be stored representing a predetermined number of angle measurements over a predetermined time interval. That is, angular position values are available from previous repetitions. A starting position and peak position may be determined by monitoring the angular positions during a repetition. For example, the peak position may be maximum angular position measured during the repetition and the starting position or bottom-most position may be the minimum angular position measured during the repetition. A total angular travel range may be defined by the peak position and the starting position. The peak position may be derived from the angular position signal measured during at least one previous repetition as the angular position value at which the angular position stops increasing. The starting position may be derived from the angular position signal measured during at least one previous repetition as the angular position value at which the angular position stops decreasing.

A stall condition may occur when the angular velocity of the pivoting arm 102 approaches zero. To ensure proper detection of a stall situation, certain lift angles may be filtered out. For example, the angular velocity goes to zero at the top and bottom of an exercise cycle. At these points, the angular velocity is expected to change polarity and pass through zero. Realizing this, one can exclude these points by detecting a stall condition only within a predetermined range of lift angles.

At operation 310, the lift angle measurement may be compared to a lower threshold value (e.g., 20 degrees). The lower threshold value may correspond to an angle indicative of approaching a bottom-most position of an exercise cycle at which angular velocity is expected to approach zero (e.g., angular position stops decreasing). Operation 326 may be executed if the lift angle measurement is less than or equal to the lower threshold value. At operation 326, a flag may be set indicating the bottom of an exercise cycle. Operation 324 may then be executed to hold the linear actuator 110 in the current position. For example, no voltage is applied to the linear actuator 110. The lower threshold value may be a minimum angular position of the predetermined range of lift angles and may be a predetermined percentage greater than the starting angular position of the total angular travel range.

Operation 312 may be executed if the lift angle measurement is greater than the lower threshold value. At operation 312, the measured angle may be compared to an upper threshold value (e.g., 95 degrees). The upper threshold value may correspond to an angle indicative of approaching a top-most position of an exercise cycle at which angular velocity is expected to approach zero (e.g., angular position stops increasing). Operation 328 may be executed if the measured lift angle is greater than or equal to the upper threshold value. At operation 328, a flag may be set indicating the top of an exercise cycle. Operation 324 may then be executed to hold the linear actuator 110 in the current position.

Operation 314 may be executed if the lift angle measurement is less than the upper threshold value. At operation 314, a check is made to determine if the lift angle in increasing. A rate of change of the angular position (e.g., angular velocity) may be computed and compared to a predetermined threshold. For example, an angular velocity greater than zero may be indicative of an increasing lift angle. In another example, a maximum angle from the previous three measurements may be computed. A difference between the maximum angle and the current angle measurement may be computed and compared to a threshold (e.g., 7 degrees). If the angle is not increasing, then operation 330 may be executed. At operation 330, a flag may be set indicating a negative exercise cycle. That is, the pivoting arm 102 is moving toward the rest position. Operation 324 may then be executed to hold the linear actuator 110 in the current position. The upper threshold value may be a maximum angular position of the predetermined range of lift angles and may be a predetermined percentage less than the peak angular position of the total angular travel range.

If the angle is increasing, then operation 316 may be performed. At operation 316 a stall condition is monitored. A rate of change of the measured lift angle may be computed. If the rate of change is less than a predetermined rate, a stall condition may be detected. The rate of change may be monitored to determine if the polarity of the rate of change reverses. This may be indicative of a stall condition. For example, a difference between the present angle measurement and the maximum angle from the previous three angle measurements may be computed and compared to a stall threshold (e.g., 16 degrees). If a stall condition is not detected, then operation 332 may be performed. At operation 332, a flag may be set indicate a non-stall condition. Operation 324 may then be executed to hold the linear actuator 110 in the current position.

If a stall condition is detected, then operation 318 may be performed. At operation 318 a flag may be set indicating the stall condition. The linear actuator 110 may be operated to retract the actuator travel arm 120. The effect is to reduce the load so that the exercise cycle may continue. For example, the microcontroller 210 may apply a negative voltage to the terminals of the linear actuator 110. If the angular velocity begins to increase again, the voltage may be set to zero to hold the position.

After operation 324 and operation 318, operation 322 may be performed. At operation 322, a check is performed to determine if the exercise session has ended. For example, a number of exercise cycles may be monitored and if the number is greater than a target number, the set may be complete. Alternatively, the lift angle may indicate that the pivoting arm 102 is in the rest position for more than predetermined inactivity time. In some configurations, a user input received from the user interface 224 may indicate the end of the exercise session. If the set has not ended, the sequence may repeat starting at operation 304. The sequence starting at operation 304 may be repeated at periodic time intervals according to a selected sample rate. For example, the sequence of operations may be repeated every 0.25 seconds. If the exercise session is complete, operation 320 may be performed. At operation 320, exercise metrics may be computed. The exercise metrics may be stored in non-volatile memory for later retrieval. The exercise metrics may also be displayed on the display or remote device.

The microcontroller 210 may be programmed to calculate an average force and energy lifted during the exercise session to provide a continuous performance metric. For example, the weight mounted to the weight support bar 130 along with a weight associated with the apparatus itself may be estimated. In some configurations, the current applied to move the actuator travel arm 120 may be monitored during motion. The weight may be obtained from a lookup table indexed by the current measurement. In other configurations, the weight may be entered via the user interface 224.

The applied force may be estimated based on the weight, distances $d_1$ and $d_2$, and the angular acceleration. The minimum torque required to begin moving the pivoting arm 102 may be computed as discussed herein. The torque for accelerating the pivoting arm 102 may be computed from the angular acceleration and a moment of inertia of the pivoting arm 102. The weight and distances may be used to compute the inertia of the pivoting arm 102. The inertia may be computed by the microcontroller 210 based on measured and stored parameters associated with the apparatus. In addition, the inertia may change dynamically during an exercise cycle based on the lift angle and mode of control (e.g., change in length of pivoting arm 102). The force may be computed from the torque values. An average force may be computed during the exercise session and stored in non-volatile memory and output to the user interface 224. Knowing the force and/or torque, an amount of energy expended may be computed, stored in non-volatile memory and output to the user interface 224.

Additional metrics may be computed. For example, the number of exercise cycles during the exercise session may be computed by counting the number of up/down cycles. In addition, an average force or energy per repetition may be computed for the exercise session. A total amount of weight lifted may be computed as a sum of the weights (or average weight) associated with each exercise cycle. An average rotational speed over the exercise cycle may be computed. Various other performance metrics may be computed and output to the user interface 224.

The ECU 200 may be programmed to estimate an average force over a number of repetitions. The number of repetitions may be a targeted number selected by the user depending upon specific fitness goals. The average force value may be stored in memory and displayed via the user interface 224. For example, computing an average force over six repetitions may be useful for monitoring strength increases. Computing an average force over ten repetitions may be useful for monitoring for muscle hypertrophy. Computing an average force over fourteen repetitions may be useful for monitoring endurance. In addition, an average energy for a set of repetitions may be computed. The metrics provide an improved indication of exercise progress.

The ECU 200 may also be utilized to implement various weight profiles during an exercise session. For example, the microcontroller 210 may be programmed to vary the weight according to a user selected profile. A profile that varies the resistance during an exercise cycle may be implemented. For example, a resistance profile may start with a lower resistance at the bottom of the exercise cycle and increase as the angle increases. A profile that maintains a constant resistance over the entire exercise cycle may be selected. For example, the microcontroller 210 may be programmed to vary the position of the actuator travel arm 120 to maintain a constant resistance as a function of the lift angle. Numerous other profiles are possible.

To achieve a particular resistance, the target resistance value may be translated to a target position of the actuator travel arm 120. The target position may be a function of the weight applied to the pivoting arm 102 which may be measured or estimated. The microcontroller 210 is programmed to operate the linear actuator 110 to achieve the target position during the exercise session. The target position may vary during an exercise cycle such that the actuator travel arm 120 moves (e.g., retracts and extends) relative to the actuator guide arm 116 during the exercise cycle. Other profiles may maintain a constant target position during an exercise cycle and change the target position at the start of the next exercise cycle.

Figure 14:
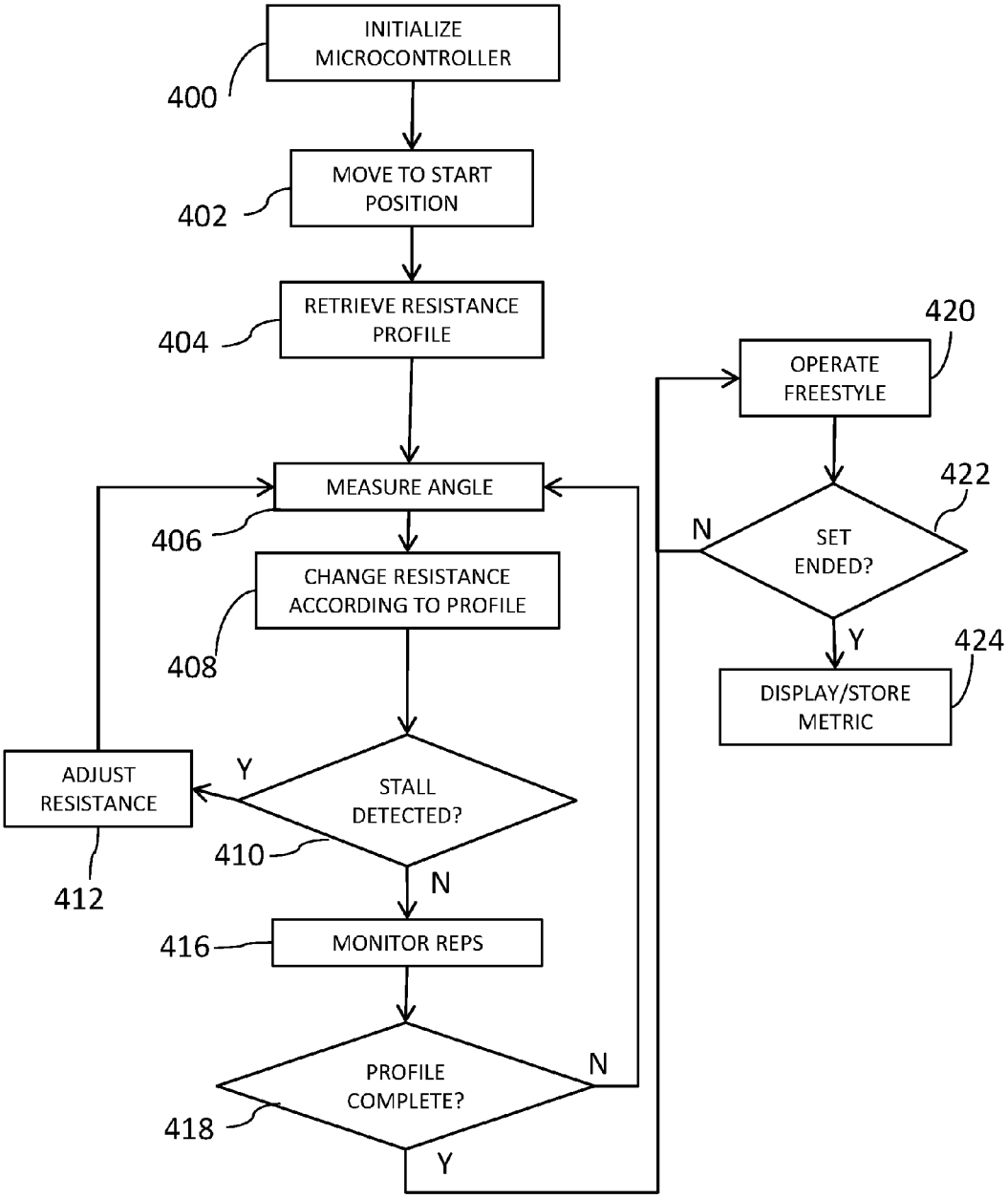
FIG. 14 is a possible logic flowchart depicting operations performed by the electronic control system for implementing a resistance profile.

FIG. 14 depicts a possible sequence of instructions that may be implemented by the microcontroller 210. At operation 400, the microcontroller may be initialized. At operation 402, a voltage may be applied the linear actuator 110 position the actuator travel arm 120 to a starting position. For example, the actuator travel arm 120 may be positioned in a mid-range position that is approximately in the middle of the fully extended and the fully retracted position.

At operation 404, a resistance profile may be read from memory or entered by the user. The resistance profile may include a period of increasing resistance. The resistance profile may include a period of constant resistance. The resistance profile may include a period of adaptive resistance based on performance of the user. The resistance profile may be defined for a predetermined number of exercise cycles. In various examples, the resistance profile may be expressed as a resistance torque profile based on time, repetition, and/or lift angle. The resistance profile may provide a target resistance torque during an exercise session. At operation 406, the angle of the pivoting arm 102 may be measured by sampling the signal from angular rotation sensor 150. At operation 408, the resistance may be changed according the selected profile. The present resistance torque may be compared to the target resistance torque and the linear actuator 110 may be controlled to drive the resistance torque to the target resistance torque. For example, the microcontroller 210 may command a voltage signal to the linear actuator 110 to extend or retract the actuator travel arm 120 based on the deviation between the desired resistance and the present resistance. The actuator travel arm 120 may be controlled to a position that is derived from the resistance profile. For example, the linear actuator 110 may be controlled to maintain a constant torque moment during the range of motion of the pivot arm 102. The pivot arm 102 may be extended and retracted as the lift angle changes to cause a constant torque moment about the pivot axis.

At operation 410, conditions for a stall condition may be checked. For example, stall detection operations from FIG. 13 may be performed to determine if the pivoting arm 102 has stalled during a lift operation. If a stall condition is detected, operation 412 is performed. At operation 412, the resistance is adjusted to compensate for the stall condition. The target resistance torque may be decreased in response to a stall condition. For example, the actuator travel arm 120 may be retracted a predetermined distance to reduce the resistance. The actuator travel arm 120 may also be retracted until motion of the lift bar 134 resumes (e.g., the lift angle begins increasing again).

If no stall condition is present, then operation 416 may be performed. Operation 416 may monitor the number of exercise cycles and store the number in memory for later use. At operation 418, a check may be performed to determine if the profile has been completed. If the profile is not completed, the sequence of operations starting with operation 406 may be repeated. If the profile is completed, operation 420 may be executed. At operation 420, the machine may be operated in a freestyle mode that may be similar to that described in FIG. 13. At operation 422, a check is made to determine is the exercise session is ended. For example, the measured angle may be checked to determine if the pivoting arm 102 is in the resting position for more than a predetermined time. If the set has not ended, operation 420 may be repeated. If the set has ended, operation 424 may be executed to compute, display and/or store the various metrics from the exercise session.

The operation of the arm curl apparatus 100 is representative of how the dynamically adaptive direct lift weight machine may be configured. The structural elements described in relation to the arm curl apparatus 100 may be applied to other configurations. In addition, the control and monitoring operations described may be extended to other configurations in a similar manner. The features and functions described in relation to the arm curl apparatus 100 may be applied to additional exercise devices.

Figure 15:
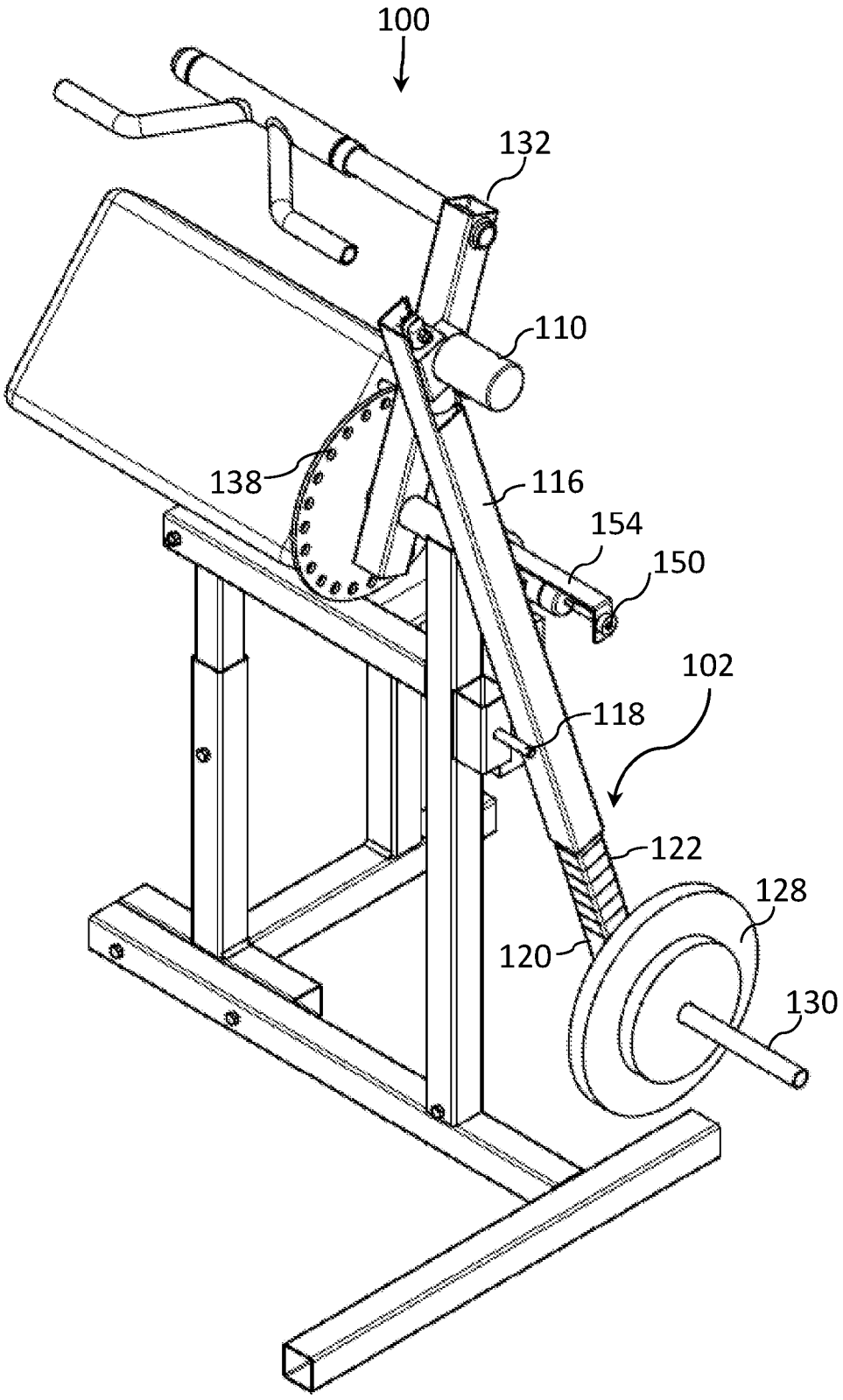
FIG. 15 is a front oblique view of a triceps extension machine configuration.

FIG. 15 depicts the arm curl apparatus 100 configured as a triceps extension apparatus. The triceps extension apparatus configuration may be achieved by rotating the actuator guide arm 116 about the pivot axis member 124 to be on the other side of the actuator guide arm stop 118 and by readjusting the lift arm 132 through the lift arm position selector 138 to be more vertical. In this configuration, the apparatus functions in a triceps extension push, rather than a biceps curl pull. The variable resistance mechanism and the electronic control unit 200 are the same as for the arm curl apparatus 100.

Figure 16:
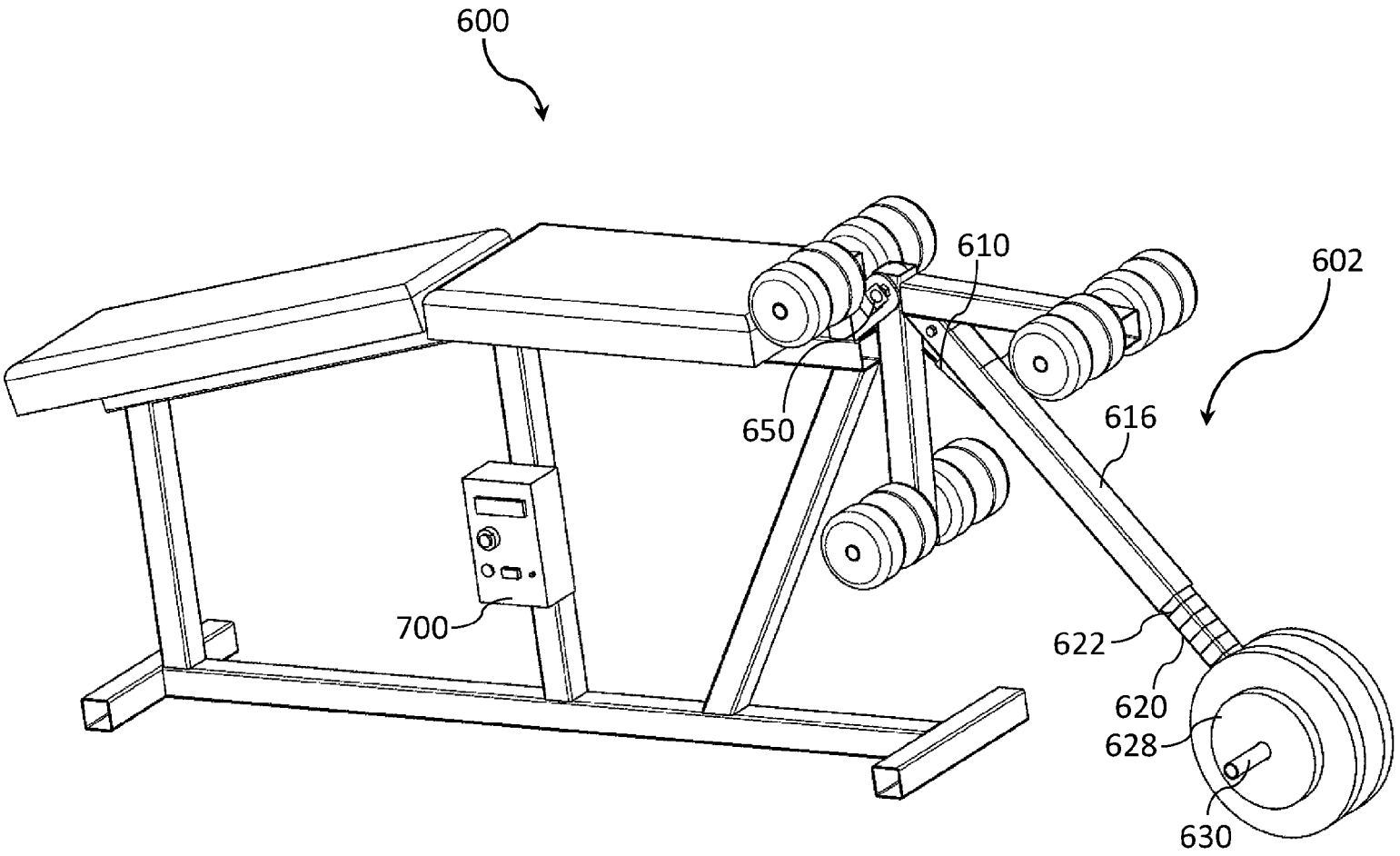
FIG. 16 is a side view of a leg extension/leg curl apparatus.

FIG. 16 depicts a leg extension/leg curl apparatus 600 utilizing similar components and structure as the arm curl apparatus 100. In this configuration, the pivoting arm 602 includes the actuator guide arm 616 and the actuator travel arm 620. The actuator travel arm 620 may include graduation marks 622. A weight support bar 630 is coupled to the actuator travel arm 620 to receive one or more weight plates 628. The linear actuator 610 is coupled to the actuator travel arm 620. An angular rotation sensor 650 may be coupled at the pivot axis to measure rotation of the pivoting arm 602. The pivoting arm 602 may be operated in a similar manner as described for the arm curl apparatus 100. Although the apparatus 600 differs from the arm curl apparatus 100, the variable resistance mechanism and the electronic control unit 700 may be the same.

The system may also be adapted to an abdominal crunch apparatus utilizing similar components and structure as the arm curl apparatus 100. In this configuration, the pivoting arm includes the actuator guide arm and the actuator travel arm. The actuator travel arm may include graduation marks. A weight support bar may be coupled to the actuator travel arm to receive weight plates. The linear actuator may be coupled to the actuator travel arm. The pivoting arm may be operated in a similar manner as described for the arm curl apparatus 100. Although the abdominal crunch apparatus differs from the arm curl apparatus 100, the variable resistance mechanism and the electronic control unit may be the same.

The system may also be adapted to a T-bar rowing apparatus utilizing similar components and structure as the arm curl apparatus 100. In this configuration, the pivoting arm includes the actuator guide arm and the actuator travel arm. The actuator travel arm may include graduation marks. A weight support bar may be coupled to the actuator travel arm to receive weight plates. The linear actuator may be coupled to the actuator travel arm. The pivoting arm may be operated in a similar manner as described for the arm curl apparatus 100. Although the T-bar rowing apparatus differs from the arm curl apparatus 100, the variable resistance mechanism and the electronic control unit may be the same.

Figure 17:
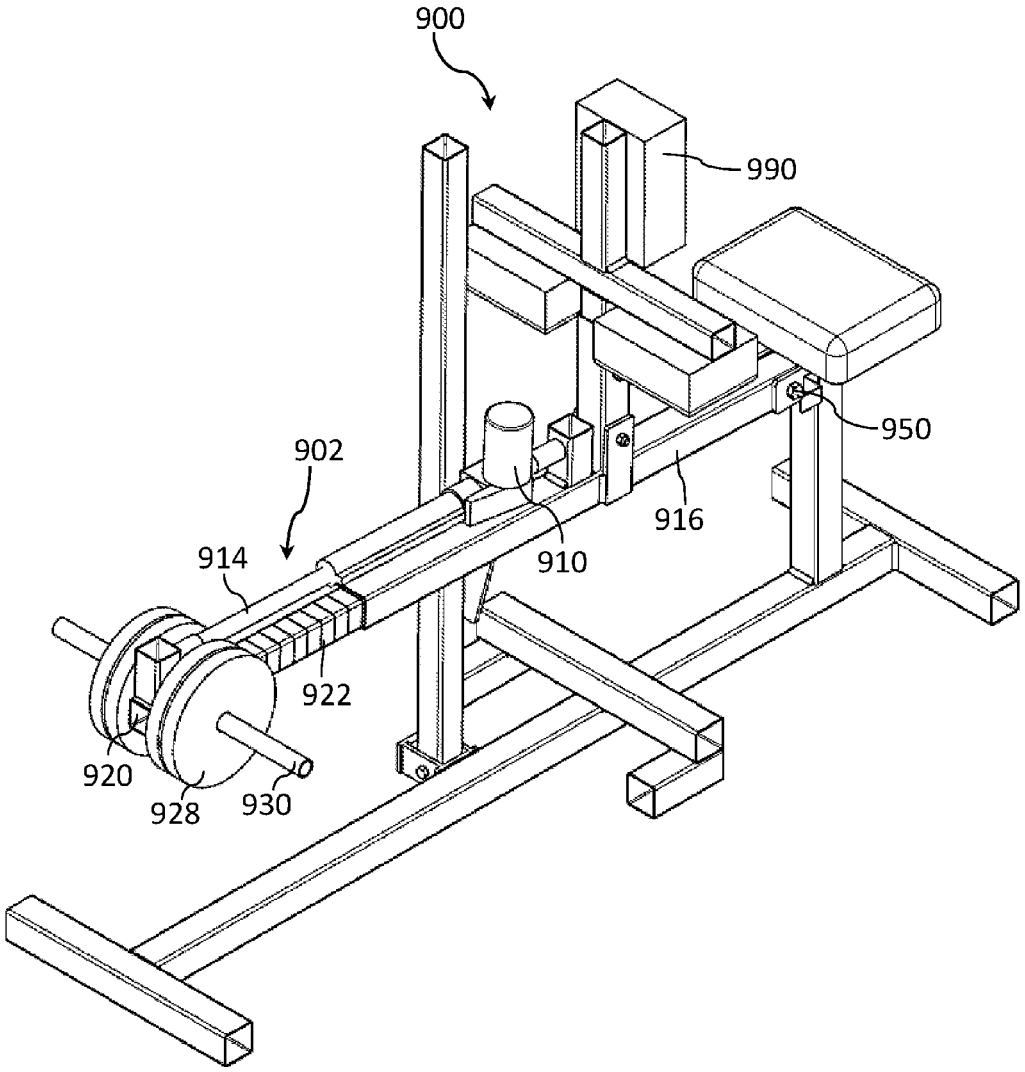
FIG. 17 is a side oblique view of a seated calf raise apparatus.

FIG. 17 depicts a seated calf raise apparatus 900 utilizing similar components and structure as the arm curl apparatus 100. In this configuration, the pivoting arm 902 includes the actuator guide arm 916 and the actuator travel arm 920. The actuator travel arm 920 may include graduation marks 922. A weight support bar 930 is coupled to the actuator travel arm 920 to receive one or more weight plates 928. The linear actuator 910 is coupled to the actuator travel arm 920 via a linear actuator arm 914. The apparatus 900 may include an angular rotation sensor 950 coupled at the pivot axis to measure rotation of the pivoting arm 902. The pivoting arm 902 may be operated in a similar manner as described for the arm curl apparatus 100 using a controller 990. Although the apparatus 900 differs from the arm curl apparatus 100, the variable resistance mechanism and the electronic control unit may be the same.

In the alternative configurations depicted in FIGS. 15-17, the pivoting arm for each configuration operates similar to the pivoting arm 102 of the arm curl apparatus 100. Components described in relation to the arm curl apparatus 100 may be present in similar positions for the alternative configurations. In addition, control and monitoring strategies described in relation to the arm curl apparatus 100 are applicable to the alternative configurations. For example, stall detection and weight relief strategies described are applicable to the alternative configurations. In addition, sensor and controller configurations described in relation to the arm curl apparatus 100 are applicable to the alternative configurations.

Figure 18:
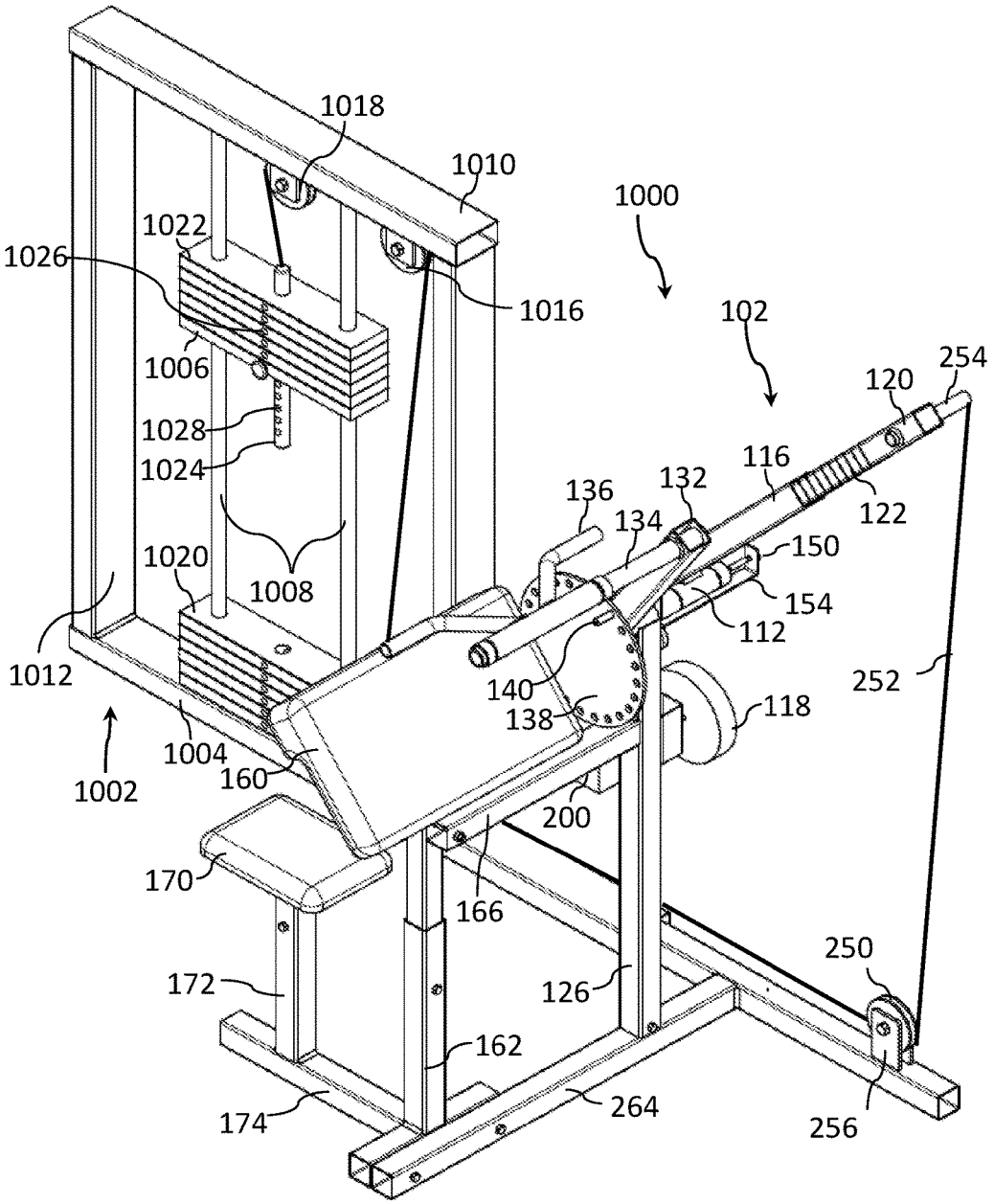
FIG. 18 is a front oblique view of a preacher arm curl apparatus coupled to a weight stack at a top/lifted position of a repetition and in an extended state.

The arm curl apparatus 100 and other variations are further adaptable to usage with a weight stack. The weight support bar 130 may be eliminated and replaced with an attachment point for a weight stack cable. FIG. 18 depicts an arm curl weight stack configuration 1000 in which the arm curl apparatus 100 described herein is adapted for use with a weight stack 1002. A modified base cross support 264 may be configured to rest on the ground or floor surface. A pulley attachment mechanism 256 may be attached to the modified base cross support 264. The pulley attachment mechanism 256 is configured to receive a pulley 250. The pulley attachment mechanism 256 may support a central axle of the pulley 250 such that the pulley 250 is free to rotate. A cable 252 may be configured to attach to a cable attachment device 254 that is coupled to the actuator travel arm 120. For example, the cable attachment device 254 may be a pin that extends from the actuator travel arm 120. The cable 252 may be configured such that an end of the cable 252 is formed as a loop that fits over the cable attachment device 254. The cable attachment device 254 may include a lip at an end furthest from the actuator travel arm 120 to aid in retaining the loop of the cable 252. In other configurations, the cable attachment device 254 may be a bolt that is placed through the loop and an opening defined in the actuator travel arm 120 and secured with a nut on an opposite side.

The cable 252 may be routed through the pulley 250 to the weight stack 1002. The weight stack 1002 may include a weight stack base 1004 that is configured to rest on the ground or floor surface. The weight stack 1002 may include at least one weight stack support member 1012 that is coupled to the weight stack base 1004. In some configurations, the weight stack base 1004 may be coupled to the modified base cross support 264. The weight stack 1002 may include at least one weight stack upper support member 1010. The weight stack 1002 may include a plurality of weight elements 1022 that are configured in a stack. The weight stack base 1004, the weight stack support member 1012 and the weight stack upper support member 1010 may be configured to support the weight elements 1022 at rest and during exercise cycles.

Each of the weight elements 1022 may be have a predetermined weight. The weight elements 1022 are not necessarily the same weight. The weight elements 1022 may be configured to move in a generally vertical direction from the ground or floor surface. The weight stack 1002 may include one or more weight guides 1008 that are configured to restrain motion of the weight elements to a limited number of directions. For example, the weight guides 1008 may be a pair of poles coupled between the weight stack base 1004 and the weight stack upper member 1010. The weight elements 1022 may be configured with openings at locations corresponding to a distance between the weight guides 1008 (e.g., the pair of poles). The weight elements 1022, when the pair of poles are received by the openings, are then constrained to move in a direction along the poles. The weight guides 1008 may be installed in a generally vertical direction so that the weight elements 1022 are generally constrained to move in a generally vertical direction (e.g., up or down relative to the ground).

The weight stack 1002 may include a weight selection mechanism 1024 for adjusting the number of weighting elements 1022 that are coupled to the cable 252. For example, the weight selection mechanism 1024 may be a member that is coupled at a first end to the cable 252. The weight selection mechanism 1024 may be received by an opening in each of the weighting elements 1022. For example, the weighting elements 1022 may define a central opening that is configured to receive the weight selection mechanism 1024. The weighting elements 1022 may further define weight selection openings 1026 in a side surface that correspond to weight retention openings 1028 defined in the weight selection mechanism 1024. When the weight selection mechanism 1024 is received by the weighting elements 1022, the weight selection openings 1026 of the weighting elements 1022 may line up with the weight retention openings 1028 defined in the weight selection mechanism 1024. For example, the weight stack 1002 may be configured such that, in a rest position, the weight selection openings 1026 are aligned with the weight retentions openings 1028. A pin or other retaining device may be inserted in the desired weight selection opening 1026. The pin may pass through the selected weighting element 1022 and through the corresponding weight retention opening 1028 defined by the weight selection mechanism 1024. The weighing elements 1022 that are above the selected weighing element may be lifted by motion of the cable 252. When the pin is inserted, an active weight stack 1006 and an inactive weight stack 1020 are defined. The active weight stack 1006 includes the weighting elements 1022 that move when the cable 252 is moved. The inactive weight stack 1020 includes the weighing elements 1022 that are not moved or remain in the rest position when the cable 252 is moved.

The weight stack 1002 may include a first pulley (not shown) coupled to the weight stack base 1004. The first pulley may receive the cable 252 from the pulley 250 of the arm curl apparatus. The weight stack 1002 may include a second pulley 1016 that is coupled to the weight stack upper support member 1010. The second pulley 1016 may positioned relative to the first pulley such that the cable 252 is generally vertical between the two. The weight stack 1002 may further include a third pulley 1018 that is coupled to the weight stack upper support member 1010. The third pulley 1018 may be positioned such that the cable 252 is routed to weight selection mechanism 1024. The weight stack pulleys (1016, and 1018) may be configured to route the cable 252 so that the active weight stack 1006 is lifted when the cable 252 is moved. The result is that a force from the active weight stack 1006 is transferred through the cable 252 to the actuator travel arm 120. Operation of the arm curl weight stack configuration 1000 is then similar to the operation of the preacher arm curl device 100 described previously.

FIG. 18 depicts the apparatus in which the actuator travel arm 120 is in an extended position during a lift repetition. Note that as the actuator travel arm 120 retracts and extends, the cable 252 between the pulley 250 and the actuator travel arm 120 may not remain perpendicular to the ground. That is, the force applied by the weight stack 1002 through the cable 252 may not always act in the same way as the weight plate configuration. As the position of the actuator travel arm 120 is changed, the angle between the cable 252 and the actuator travel arm 120 may vary. Thus, the force acting perpendicular to the actuator travel arm 120 may vary. During an exercise cycle, the actuator travel arm 120 may be moved under control of the ECU 200. In addition, any control operations previously described in the other configurations are applicable to the weight stack configuration. For example, stall detection and mitigation may be active.

Note that other possible configurations for the weight stack 1002 are possible. Other pulley and cable routing arrangements are possible and may be incorporated into the exercise apparatus similar to the described configuration. In addition, the weight stack 1002 may be incorporated into the exercise machine configurations depicted in FIGS. 15-17 in a similar manner.

Figure 19:
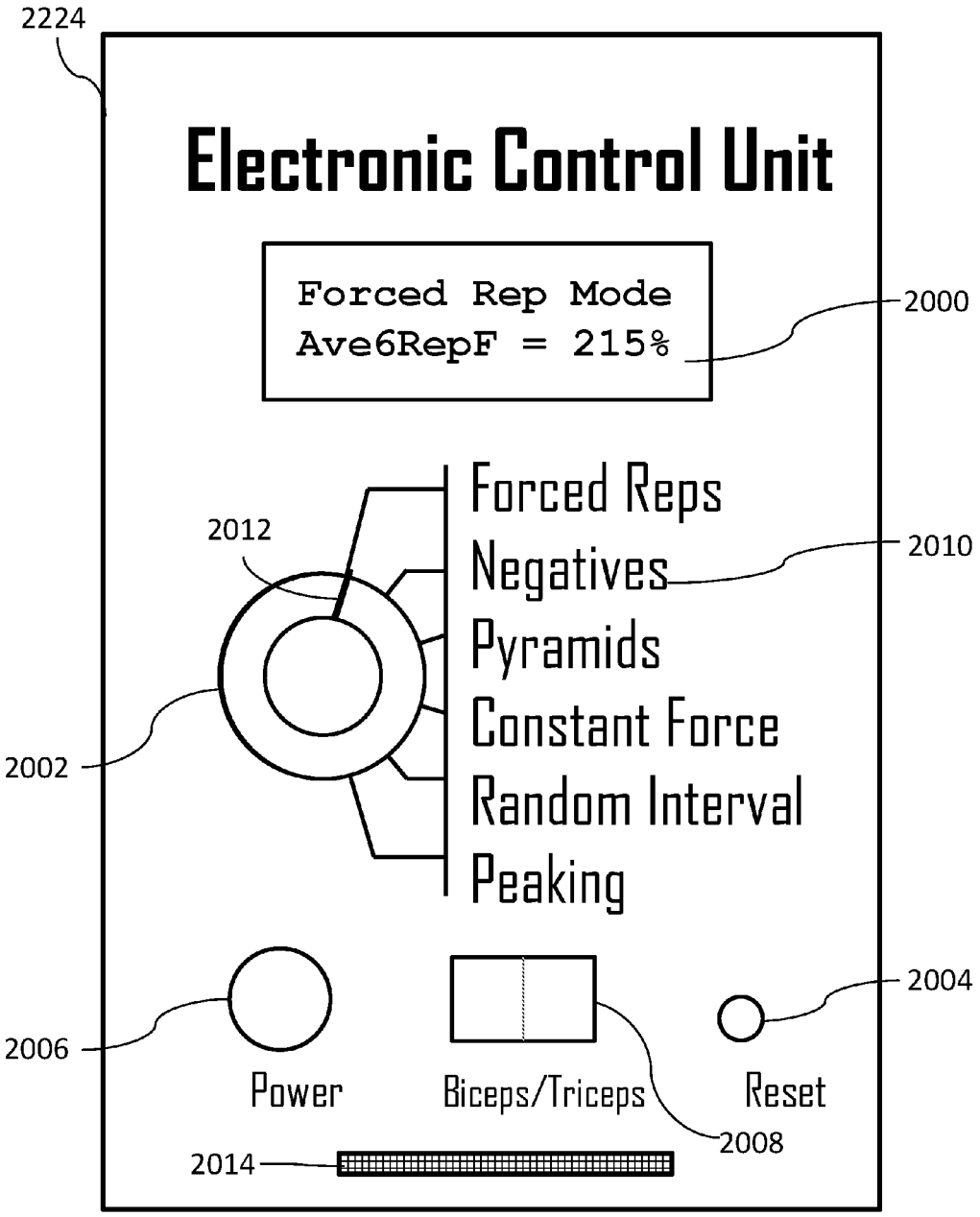
FIG. 19 is a possible user interface configuration.

FIG. 19 depicts a possible configuration for a user interface 2224. The user interface 2224 may include a display 2000. For example, the display 2000 may be a liquid crystal display (LCD). The user interface 2224 may include a rotary switch 2002. The rotary switch 2002 may be configured to have a plurality of discrete positions. Each of the positions may be used to indicate a particular exercise profile. The outputs of the rotary switch 2002 may be coupled to the microcontroller 210. The user interface 2224 may include a label 2010 that describes each of the positions of the rotary switch 2002. For example, the rotary switch 2002 may have six distinct positions. The label 2010 may be placed adjacent to the rotary switch and have an indicator for the switch position along with a textual or graphical description of the switch position. For example, the positions may be described as "Forced Reps", "Negatives", "Pyramids", "Constant Force", "Random Interval", and "Peaking". In addition, a switch cover may include a selection marker 2012 to indicate the selection position of the rotary switch 2002.

The user interface 2224 may include a power button 2006 or switch. The power button 2006 may be configured to turn the apparatus on and off. The user interface 2224 may include a reset button 2004 or switch. The reset button 2004 may be configured to reset the electronic modules to a default state. The user interface 2224 may include a selection switch 2008. For example, the selection switch 2008 may be configured to select between "Biceps" and "Triceps" mode of operation. The selection switch 2008 may be electrically coupled to the microcontroller 210. The microcontroller 210 may monitor the selection switch 2008 and operate the exercise apparatus in the selected mode of operation.

The user interface 2224 may include an audio output device 2014 that is configured to provide audio signals for the user. The audio output device 2014 may be a speaker, a chime, and/or a buzzer. The microcontroller 201 may be electrically coupled to the audio output device 2014. The ECU 200 may include circuitry to interface with the audio output device 2014. The microcontroller 210 may be programmed to output signals to the audio output device 2014.

Figure 20:
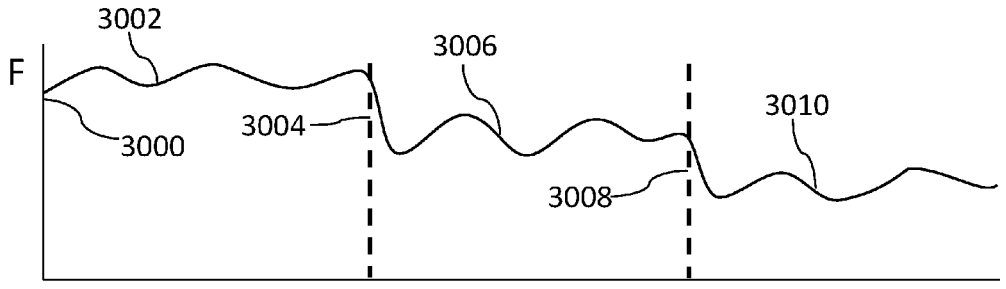
FIG. 20 is a force versus time profile for a forced repetition profile selection.

The exercise apparatus may operate according to a selected exercise profile as selected by the rotary switch 2002. The exercise profiles may be managed and controlled by the microcontroller 210. The microcontroller 210 may be programmed to implement instructions for implementing each of the exercise profiles to be described. FIG. 20 depicts a graph of force versus time for a forced repetitions exercise profile 3000. The forced repetition mode may define a starting resistance. The ECU 200 may monitor the operator performance during the exercise cycle. In the event a stall condition is detected, the ECU 200 may decrease the resistance to allow more repetitions to be completed. During an exercise cycle, each time a stall event is detected, the resistance may be decreased. For example, when a stall event is detected, the actuator travel arm 120 may be commanded to retract to decrease the resistance. For example, the ECU 200 initially commands the exercise apparatus to provide the starting resistance which results in a first force profile 3002. A first user stall event 3004 may be detected. After the first user stall 3004, the exercise apparatus is commanded to a second resistance level which results in a second force profile 3006. After a second user stall event 3008 is detected, the exercise apparatus is commanded to a third resistance level which results in a third force profile 3010.

Figure 21:
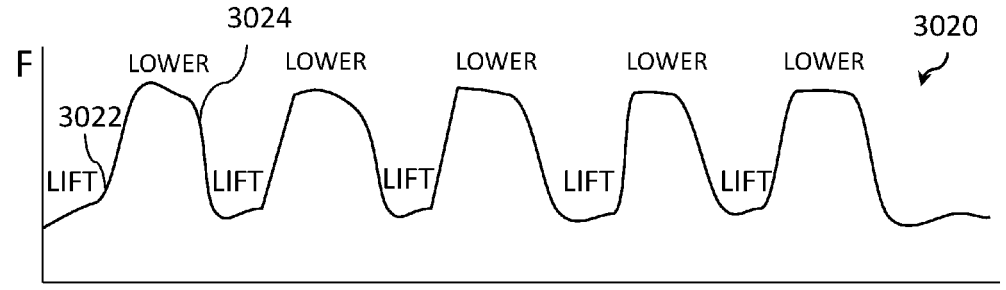
FIG. 21 is a force versus time profile for a negative profile selection.

FIG. 21 depicts a graph of force versus time for a negative exercise profile 3020. The negative exercise profile may be characterized by an increase in resistance during the downward motion of the actuator travel arm 120. During a first phase in which the actuator travel arm 120 is rising, the ECU 200 may command a lift resistance profile which results in a lift force profile 3022. As the actuator travel arm 120 begins to descend, the ECU 200 may command a descent resistance profile which results in a descent force profile 3024. During the lift resistance profile, the actuator travel arm 120 may be in a retracted position. During the lift portion, the actuator travel arm 120 may be extended at a first rate. As the actuator travel arm 120 approaches or reaches a peak angle, the resistance may be increased at a second rate that is greater than the first rate. For example, the lift phase may be defined as the interval when the angular position sensor indicates rotation of the telescoping pivot arm more than a first predetermined angle away from a starting position and toward a peak position. During the descent profile, the actuator travel arm 120 may start in an extended position. As the actuator travel arm 120 descends and approaches a final resting position, the resistance may be decreased. The descent phase may be defined as the interval when the angular position sensor indicates rotation of the telescoping pivot more than a second predetermined angle away from the peak position and toward the starting position. The negative profile may be configured to provide more resistance during the descent phase than during the lift phase.

Figure 22:
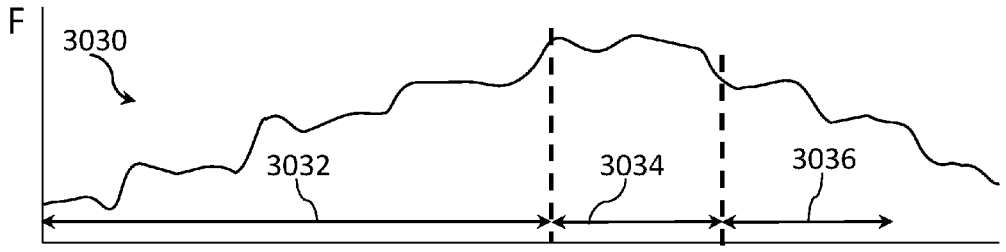
FIG. 22 is a force versus time profile for a pyramids profile selection.

FIG. 22 depicts a graph of force versus time for a pyramids exercise profile 3030. The pyramids profile may be characterized by an increase in resistance over a number of repetitions followed by a decrease in resistance as the end of the exercise cycle approaches. The ECU 200 may command an increasing resistance during an increase segment 3032 of the exercise cycle. The ECU 200 may monitor the angle of the actuator travel arm 120 to determine when a repetition is completed. For each repetition during the increase segment 3032, the resistance may be increased by a predetermined amount. The predetermined amount may be selectable by the operator. After a predetermined number of repetitions, the ECU 200 may command a constant peak resistance during a peak segment 3034. In some cases, the peak segment 3034 may be one repetition. After completion of the peak segment 3034, the ECU 200 may command a decreasing resistance profile during a decrease segment 3036. During the decrease segment 3036, the ECU 200 may command a decrease in resistance after each repetition. The general profile may resemble a pyramid. The ECU 200 commands the actuator travel arm to retract and extend to achieve the desired resistance during the profile.

Figure 23:
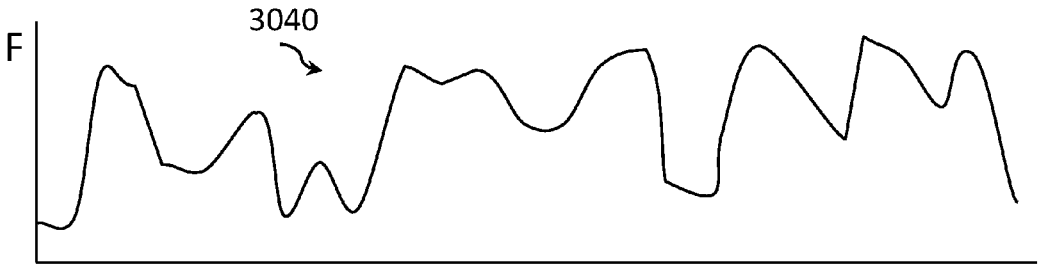
FIG. 23 is a force versus time profile for a random intervals profile selection.

FIG. 23 depicts a graph of force versus time for a random interval exercise profile 3040. The random interval profile may be characterized by a randomly selected resistance for each repetition. The ECU 200 may command a resistance that changes for each repetition. The commanded resistance may be constrained to be within a predetermined range. The predetermined range may be user selectable to ensure resistance values within the capabilities of the user. In addition, stall event detection may be enabled to prevent stall conditions. Further, during the random interval profile, stall events may be used to detect the maximum resistance that may be commanded. In this manner, resistance values may be commanded that do not cause a stall event allowing the user to perform more repetitions.

Figure 24:
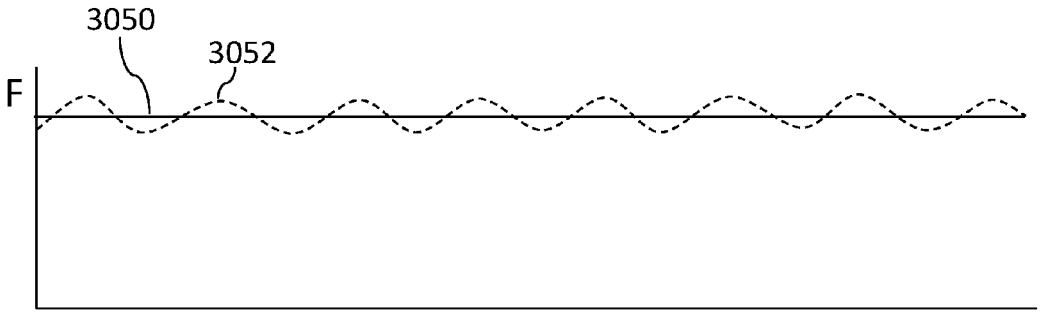
FIG. 24 is a force versus time profile for a constant force load profile selection.

FIG. 24 depicts a graph of force versus time for a constant force exercise profile. The resistance may be commanded to a constant resistance 3050 that results in a load profile 3052. The constant force profile provides a predetermined resistance. The predetermined resistance may be user selectable. In addition, stall event detection may be active during the constant force profile.

Figure 25:
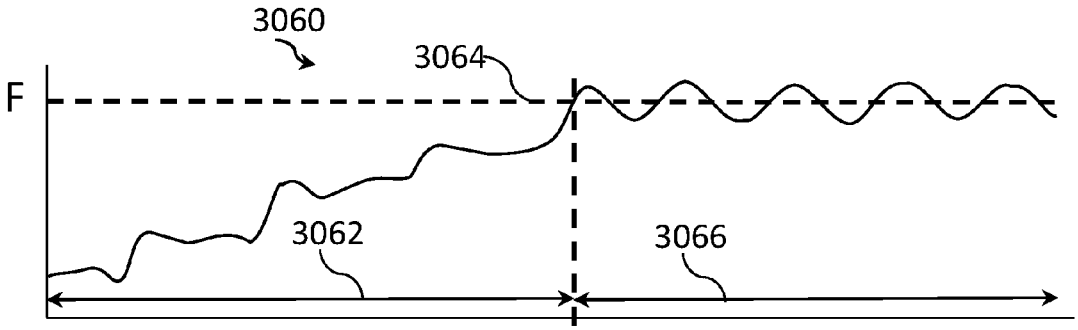
FIG. 25 is a force versus time profile for a weight selection mode.

Additional modes of operation may include dynamic rehabilitation load profiles. Such profiles may be beneficial for aiding patients that are rehabilitating from injury or surgery. FIG. 25 depicts a graph of force versus time for a weight selection exercise profile 3060. A weight selection mode may be configured to provide a reasonable resistance capability for the user. The ECU 200 may be programmed to implement a weight selection mode that is configured to increase the resistance for each repetition until a weight capability of the user is reached.

The ECU 200 may be programmed to compute an angular velocity of the actuator travel arm 120 based on a rate of change of the angular position measurement. Assuming that the angle increases during the lift phase, the angular velocity may be expected to be positive during the lift phase. Assuming that the angle decreases during a descent phase, the angular velocity may be expected to be negative during the descent phase. During the lift phase, the magnitude of the angular velocity may be referred to as the lift speed. During the descent phase, the magnitude of the angular velocity may be referred to as the descent speed.

The weight capability may be ascertained by monitoring various signals. The ECU 200 may be programmed to evaluate a lift speed condition that compares the lift speed to a predetermined threshold. The lift speed being greater than the predetermined threshold may be indicative that the user can reasonably handle additional resistance. The lift speed being less than or equal to the predetermined threshold may be indicative that a weight limit for the user has been reached.

In some configurations, electromyography (EMG) may be incorporated into the exercise. For example, leads from an electromyograph may be connected to a user of the exercise apparatus. The electromyograph may be configured to provide a signal to the ECU 200 indicative of a contraction of a muscle. The ECU 200 may include an interface (e.g., hardware and software) to receive a signal (e.g., EMG signal) from the electromyograph. The signal may correlate to the amount of resistance applied during an exercise cycle. For example, the signal may increase in magnitude as the resistance increases during an exercise session. The ECU 200 may be programmed to evaluate an EMG condition that compares the EMG signal to a predetermined threshold. The EMG signal being less than a predetermined threshold during a repetition may be indicative that the user can reasonably handle additional resistance. The EMG signal being greater than or equal to the predetermined threshold may be indicative that the weight limit for the user has been reached.

In some configurations, a heart rate sensor may be incorporated into the exercise. The heart rate sensor may be configured to provide a signal to the ECU 200 indicative of the heart rate of the operator. The ECU 200 may include an interface (e.g., hardware and software) to receive the signal from the heart rate sensor. The ECU 200 may be programmed to evaluate a heart rate signal condition that compares the heart rate signal to a predetermined threshold. The heart rate being less than a predetermined rate during a repetition may be indicative that the user can handle additional resistance. The heart rate signal being greater than or equal to the predetermined rate may be indicative that the weight limit for the user has been reached.

Note that the basic operation of the exercise apparatus may utilize the lift speed condition. In some configurations, one or more of the heart rate sensor and the EMG may be absent. In such configurations, the lift speed condition may be utilized as the lift speed may be determined from the angle sensor.

If the lift speed signal, the EMG signal, or the heart rate signal are indicative of the user being able to reasonably handle additional resistance, the resistance may be increased for subsequent repetitions. In configurations in which one or more of the signals are absent, the absent signal may be excluded from the evaluation. If lift speed signal, the EMG signal, and the heart rate signal are all indicative of a weight limit being reached, the present resistance value may be stored and indicated to the user. For example, the weight limit may be displayed via the user interface 224.

FIG. 25 depicts a graph of force versus time for a weight selection profile 3060. The weight selection mode may include a weight increase phase 3062. When one or more of the EMG signal, the lift speed signal, and the heart rate signal are indicative that the user can handle additional resistance; the ECU 200 may operate in the weight increase phase 3062. During the weight increase phase 3062, the resistance may be periodically increased. For example, the resistance may be increased by a predetermined amount every 5 seconds until an appropriate weight is selected. The weight limit for the user may be detected when the EMG signal, the lift speed signal, and the heart signal are all indicative that the user weight limit has been reached. When the weight limit is detected, the ECU 200 may operate in with a constant resistance (e.g., a constant resistance phase 3066) that is the weight limit value 3064. Upon detecting the weight limit, the ECU 200 may store the weight limit and output the weight limit value to the user interface 224 for display to the user.

Figure 26:
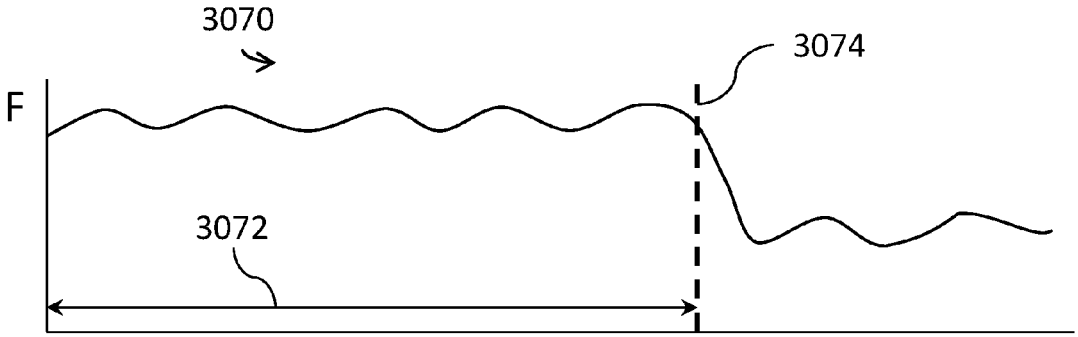
FIG. 26 is a force versus time profile for a rehabilitation mode.

FIG. 26 depicts a graph of force versus time for a rehabilitation mode profile 3070. In the rehabilitation mode, the ECU 200 may initially operate in a fixed resistance mode 3072 in which a constant resistance is commanded. The constant resistance may be the weight limit value as determined in the weight selection mode. In some configurations, the weight selection mode may be performed immediately prior to the rehabilitation mode such that when the weight limit value is determined the system transitions immediately to the rehabilitation mode.

The rehabilitation mode may operate in the fixed resistance mode 3072 until conditions are detected that are indicative of the user being unable to continue at the constant resistance or weight limit value. At a detected time 3074 at which conditions are detected indicative of the user needing assistance, intervention may be taken to assist the user. In this example, the resistance may be decreased by a predetermined amount to facilitate continuation of the exercise cycle.

Various conditions may be monitored to detect when the user is in need of assistance. The ECU 200 may be programmed to evaluate a descent speed condition that compares the descent speed to a predetermined threshold. The descent speed being greater than the predetermined threshold may be indicative that the user is having difficulty exercising at the present resistance. The descent speed being less than or equal to the predetermined threshold may be indicative that the user can continue at the present resistance.

The ECU 200 may be programmed to evaluate a lift speed condition. The lift speed being approximately zero may be indicative that the user is having difficulty exercising at the present resistance. This may be similar to a stall condition. The lift speed condition may be further conditioned on the angular position to ensure that the low lift speed is not at the peak position or rest position of the repetition.

The ECU 200 may be programmed to evaluate a range of motion angle condition. The ECU 200 may monitor the lift angle and determine a range of motion defined by a maximum angle and a minimum angle achieved during each repetition. The range of motion may be expressed as a difference between the maximum angle and the minimum angle. A baseline range of motion may be determined and stored during the weight selection mode of operation. The range of motion being less than a predetermined range may be indicative that the user is having difficulty exercising at the present resistance.

The ECU 200 may be programmed to evaluate an EMG condition. The EMG sensor value being greater than a predetermined value may be indicative of the user being unable to lift the present resistance. The ECU 200 may be programmed to evaluate a heart rate sensor condition. The heart rate sensor being greater than a predetermined value may be that the user is having difficulty exercising at the present resistance.

When a condition that is indicative of the user being unable to lift the present resistance, the ECU 200 may be programmed to reduce the resistance by a predetermined amount. In addition, an indication may be provided that the condition is present. For example, the ECU 200 may be programmed to generate an audible sound such as a chime through the audio output device 2014. In addition, the ECU 200 may display a message to the user via the display 2000.

The dynamically adaptive direct lift weight machines described provide several benefits to users. The direct coupling of structural components provides better feel to users as a more direct connection to the weight is established. The ability to dynamically vary the resistance provides additional exercise options to maintain user interest and encourage exercise. In addition, the ability to detect a stall during lifting and reduce the resistance permits additional repetitions and may help to prevent injury. The ability to provide continuous value performance metrics also helps users to better evaluate progress over time. The modes of operation described allow the user to continue exercising beyond initial exhaustion for maximum growth.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A weight training apparatus comprising:

a telescoping pivot arm comprised of a concentric arrangement of an outer tube and an inner tube and configured to pivot about an axis, the outer tube being rotatably coupled to a shaft that defines the axis and the inner tube being configured to receive a weight at a predetermined position;

an actuator, including a drive unit attached to the outer tube of the telescoping pivot arm, configured to cause relative motion between the inner tube and the outer tube to change a length between the predetermined position and the axis;

a sensor configured to output a signal indicative of an angular position of the telescoping pivot arm about the axis; and a controller programmed to operate the actuator to cause the length to change based on the signal to achieve a target resistance profile.

2. The weight training apparatus of claim 1 wherein the target resistance profile is a constant torque resistance over a predetermined range of angular motion.

3. The weight training apparatus of claim 1 wherein the controller is further programmed to, in response to a rate of change of the signal being indicative of the angular position changing at a rate less than a predetermined rate while the signal indicates that the telescoping pivot arm is rotating away from a rest position of the telescoping pivot arm, operate the actuator to cause the length to decrease.

4. The weight training apparatus of claim 1 wherein the controller is further programmed to operate the actuator to increase the length when the signal indicates rotation of the telescoping pivot arm more than a first predetermined angle away from a starting position and toward a peak position and decrease the length when the signal indicates rotation of the telescoping pivot arm more than a second predetermined angle away from the peak position and toward the starting position.

5. The weight training apparatus of claim 1 wherein the controller is further programmed to operate the actuator to increase the length by a predetermined amount in response to the signal being indicative of a start of a repetition.

6. The weight training apparatus of claim 1 wherein the telescoping pivot arm is further configured to receive a cable at the predetermined position, wherein the cable is coupled to a weight stack.

7. The weight training apparatus of claim 1 further comprising a user interface including a display and wherein the controller is further programmed to output, to the display, an average over a predetermined number of repetitions of a force value that is based on the length and the angular position derived from the signal.

8. The weight training apparatus of claim 1 further comprising a user interface including an input element configured to provide an input signal for selecting an exercise profile and wherein the controller is further programmed to receive the input signal, and in response to the input signal, change the target resistance profile according to the exercise profile that is selected.

9. The weight training apparatus of claim 1 wherein the controller is further programmed to operate the actuator to increase the length for each repetition of an exercise cycle until a rate of change of the signal falls below a predetermined rate while the angular position is increasing within a predetermined angle range.

10. The weight training apparatus of claim 1 wherein the controller is further programmed to, in response to a rate of change of the signal being indicative of the angular position changing at a rate exceeding a predetermined descent rate while the signal indicates rotation toward a rest position of the telescoping pivot arm, operate the actuator to reduce the length until the rate of change is less than the predetermined descent rate.

11. A weight training system comprising:

a telescoping pivot arm comprised of a concentric arrangement of an outer tube and an inner tube and configured to pivot about an axis and receive a weight at a predetermined position;

an actuator attached to the telescoping pivot arm and configured to cause relative motion between the inner tube and the outer tube to change a length between the predetermined position and the axis;

a sensor configured to output a signal indicative of an angular position of the telescoping pivot arm about the axis; and a controller programmed to operate the actuator to cause the length to change based on the signal to achieve a target resistance profile and, in response to a rate of change of the signal being indicative of the angular position changing at a rate less than a predetermined lift rate while the signal indicates rotation away from a rest position of the telescoping pivot arm and within a predetermined angular position range from the rest position, operate the actuator to reduce the length until the rate of change is greater than the predetermined lift rate.

12. The weight training system of claim 11 wherein the predetermined lift rate is a rate indicative of a stall condition during a lift phase of a repetition.

13. The weight training system of claim 11 wherein the controller is further programmed to, in response to the rate of change of the signal being indicative of the angular position changing at a rate exceeding a predetermined descent rate while the signal indicates rotation toward the rest position, operate the actuator to reduce the length until the rate of change is less than the predetermined descent rate.

14. The weight training system of claim 11 wherein the predetermined angular position range is less than a total angular travel range measured during at least one previous repetition.

15. The weight training system of claim 14 wherein a maximum angular position of the predetermined angular position range is a predetermined percentage less than a peak angular position of the total angular travel range that is derived from the signal measured during at least one previous repetition as an angular position value at which the angular position stops increasing.

16. The weight training system of claim 14 wherein a minimum angular position of the predetermined angular position range is a predetermined percentage greater than a starting angular position of the total angular travel range that is derived from the signal during at least one previous repetition as an angular position value at which the angular position stops decreasing.

17. The weight training system of claim 14 wherein the predetermined angular position range is a predetermined percentage of the total angular travel range.

18. A weight training apparatus comprising:

a telescoping pivot arm comprised of a concentric arrangement of an outer tube and an inner tube and configured to pivot about an axis and receive a weight at a predetermined position;

an actuator attached to the telescoping pivot arm and configured to cause relative motion between the inner tube and the outer tube to change a length between the predetermined position and the axis;

a sensor configured to output a signal indicative of an angular position of the telescoping pivot arm about the axis; and a controller programmed to operate the actuator to cause the length to change based on the signal to achieve a target resistance profile, estimate the length based on a control signal provided to the actuator, and output, to a display, an average over a predetermined number of repetitions of a force value that is based on the length and the angular position derived from the signal.

19. The weight training apparatus of claim 18 wherein the controller is further programmed to receive, from a user interface, a weight value that is indicative of a force due to gravity of the weight located at the predetermined position and wherein the force value is further based on the weight value.

* * * * *